US007803241B2

(12) United States Patent
Cundiff et al.

(10) Patent No.: US 7,803,241 B2
(45) Date of Patent: Sep. 28, 2010

(54) COMPOSITE PRESSURE TANK AND PROCESS FOR ITS MANUFACTURE

(75) Inventors: Roy S. Cundiff, Long Beach, CA (US); Aaron S. Leichner, Los Angeles, CA (US)

(73) Assignee: Microcosm, Inc., Hawthorne, CA (US)

( * ) Notice: Subject to any disclaimer, the term of this patent is extended or adjusted under 35 U.S.C. 154(b) by 988 days.

(21) Appl. No.: 11/599,211

(22) Filed: Nov. 14, 2006

(65) Prior Publication Data

US 2007/0205201 A1 Sep. 6, 2007

Related U.S. Application Data

(63) Continuation-in-part of application No. 10/121,737, filed on Apr. 12, 2002, now Pat. No. 7,195,133.

(51) Int. Cl.
*B65H 81/00* (2006.01)

(52) U.S. Cl. ..... 156/155; 156/169; 156/170; 156/173; 156/175

(58) Field of Classification Search ..... 156/155, 156/169, 170, 173, 175
See application file for complete search history.

(56) References Cited

U.S. PATENT DOCUMENTS

| | | | | | |
|---|---|---|---|---|---|
| 2,848,133 | A * | 8/1958 | Ramberg | ..... | 220/590 |
| 3,321,347 | A * | 5/1967 | Price et al. | ..... | 156/151 |
| 3,508,677 | A * | 4/1970 | Laibson et al. | ..... | 220/590 |
| 5,383,566 | A * | 1/1995 | Johnson | ..... | 220/562 |
| 7,195,133 | B1 * | 3/2007 | Cundiff et al. | ..... | 220/589 |

FOREIGN PATENT DOCUMENTS

| | | |
|---|---|---|
| DE | 2323708 | * 11/1974 |

* cited by examiner

*Primary Examiner*—Jeff H Aftergut
(74) *Attorney, Agent, or Firm*—Noel F. Heal

(57) ABSTRACT

A pressure vessel and method for producing a pressure vessel is disclosed. The pressure vessel comprises a liner shell fabricated from composite material applied to a soluble mandrel having a body shaped to pattern an interior of the pressure vessel, the liner shell having an opening, a boss having an aperture therethrough, the boss sealingly bonded to the liner shell with the aperture adjacent the opening, and an outer shell fabricated from plies of composite material filament impregnated with matrix material wound over the liner shell and the boss, but not over the aperture.

20 Claims, 25 Drawing Sheets

COMPOSITE PRESSURE TANK AND PROCESS FOR ITS MANUFACTURE

CROSS-REFERENCE TO RELATED APPLICATIONS

This application is a continuation-in-part and commonly assigned application Ser. No. 10/121,737, entitled "COMPOSITE PRESSURE TANK AND PROCESS FOR ITS MANUFACTURE," by Roy S. Cundiff and Anthony Mancuso, filed Apr. 12, 2002, now U.S. Pat. No. 7,195,133, which application is hereby incorporated by reference herein.

BACKGROUND OF THE INVENTION

1. Field of the Invention

The present invention relates generally to pressure vessels, and more particularly, to pressure vessels used for storage of cryogenic and other materials in rocket launch and space vehicle applications.

2. Description of the Related Art

In aerospace applications, pressurized propellant tanks may be fabricated by filament winding fiber reinforcement over a thin walled metallic liner. Carbon or fiberglass fibers provide the required strength without the weight penalty associated with an all-metallic tank. Unfortunately, composite pressure vessels with metallic liners present a thermal stress problem, when used to store cryogenic materials. Specifically, significant differences in the coefficients of thermal expansion (CTE), between the metallic liner and the composite outer shell, result in high thermal stresses at the interface. These thermal stresses can be significant enough to cause rupture of the vessel if not addressed. A vessel fabricated with only composite materials would obviate the disadvantages of using a metallic liner. In lieu of a metallic liner, a composite shell can be used and reinforcement fiber wound over it.

There are basically two techniques for a fabricating a composite shell to filament wind over, (1) hand layup and (2) filament winding. In the hand layup process, sections of the material in the form of fabric are laid over a tool (or pattern) that defines the internal surface of the vessel or sections of the vessel. The fabric, for example, may be fiberglass or graphite fabric. The resulting composite (or laminate) consists of layers of fabric impregnated with a matrix binder, such as an epoxy resin. The resin is applied wet and is cured to a hard shell.

After curing, the tool must be removed, which requires that the part of the vessel so formed must have an open end through which the tool may be withdrawn or the tool can be fabricated from a material such as eutectic salt which can be dissolved. The simplest and most direct approach for removing the tooling is to fabricate the composite shell in two halves, which are later joined together with a splice (or "bellyband") of similar composite material.

The filament winding technique for fabricating a composite shell is similar, except the material takes the form of continuous bands of fiberglass or graphite fibers, either previously impregnated with a matrix material or impregnated during winding. The fibers are filament wound over a rotating and removable form. For the filament winding process, the vessel is prepared as a whole vessel, which must be cut in two to remove the tool.

Composite pressure vessels for aerospace applications can be very expensive due largely to the need for an autoclave. Autoclaves control the temperature and pressure during curing and can be expensive devices, especially if the vessels to be manufactured are large.

It will be appreciated from the foregoing that there is a need for an all-composite pressure vessel that has no need of a metal liner, and preferably has no need for autoclaving during fabrication. The present invention satisfies this need.

SUMMARY OF THE INVENTION

The present invention resides in a reliable pressure vessel for containing cryogenic or other materials but without the weight and high cost usually associated with such vessels. Briefly, and in general terms, the pressure vessel of the present invention comprises an inner shell fabricated from composite material, over which a composite outer shell is filament wound. Both liner and outer shell utilize out-of-autoclave cured composites. In the disclosed embodiment of the invention, the vessel has a cylindrical body with geodesic iso-tensoid dome contours, at each end. The vessel includes polar end fittings, which are bonded to the dome and provide a means for filling and evacuating. The polar end fittings may be metallic or a composite material.

The vessel further comprises a skirt at each end of the vessel, extending cylindrically over a portion of each domed end. A cryogenically compliant, adhesive shear ply is used at the skirt/dome y-joint area to reduce stress peaking at the interface.

Any of a variety of composite materials may be used for fabricating the liner shell and the outer structure of the vessel, including fiberglass and carbon in fabric and fiber form. The vessel may also include a coating of a cryogenically compliant material applied to the inside surface of the inner shell prevent micro-cracking of the inner surface during cryogenic applications and to reduce the permeability of the composite liner.

In another embodiment the pressure vessel comprises a liner shell fabricated from composite material applied to a soluble mandrel having a body shaped to pattern an interior of the pressure vessel, the liner shell having an opening, a boss having an aperture therethrough, the boss sealingly bonded to the liner shell with the aperture adjacent the opening, and an outer shell fabricated from plies of composite material filament impregnated with matrix material wound over the liner shell and the boss, but not over the aperture.

The invention may also be defined as a process for fabricating a pressure vessel for both cryogenic and non-cryogenic materials. Briefly, and in general terms, the process comprises the following steps: 1) Preparing a tool, which is shaped to conform to the inner surface (inner mold line) of the pressure vessel, on which to fabricate the liner shell. Polar end fittings are set and bolted in place, but not bonded, onto the tool body at each polar end of the vessel, where openings are desired into the vessel. 2) Layers of composite material are laid-up or filament wound over the tool to form a composite liner shell. For hand lay-up the composite liner is formed in two halves. Filament wound liners are fabricated in one piece and then cut in half along the center cylinder. The liner shell is then cured out of autoclave with heat lamps. 3) The tool and the polar end fittings are removed from the shell. 4) The polar end fittings are bonded onto the dome ends of each half of the liner. 5) The two halves of the liner are bonded together with a splice band (or "bellyband") to form a complete liner shell for the vessel. 6) The liner shell is then mounted on a filament-winding machine and over-wrapped with multiple layers of reinforcement fiber. Curing is performed out-of-autoclave with heat lamps.

The step of assembling the two half portions of the liner shell includes forming an annular inner bellyband of composite material. The inner bellyband has an outside diameter selected to fit along the inside surface of the liner shell. The step of assembling the two half portions further includes bonding the inner bellyband with adhesive onto one of the shell halves, leaving half of the axial length of the inner bellyband protruding from the liner half; securing the protruding part of the inner bellyband with adhesive to the other shell half; and then forming an outer bellyband of composite material around the liner shell, to strengthen the joint between the two halves and to complete their assembly.

Further, the step of installing the polar end fittings includes preparing the surface of the fittings and the inner surface of the shell to receive the fittings; applying an adhesive to the inner surface of the shell, specifically around the opening to receive the fittings; inserting the fittings in the opening and applying pressure to adhere the fittings in the opening; applying annular layers of composite material over the fitting from inside the shell and curing the adhesive and the layers of composite material on both sides of each fitting, using heat lamps in an out-of-autoclave curing process.

The step of filament winding includes winding multiple helical layers extending over the entire surface of the structure and multiple hoop layers extending over only the cylindrical portion of the surface. In the disclosed embodiment of the invention, the vessel includes a cylindrical body with geodesic, iso-tensoid dome profiles, and the step of filament winding further includes forming a skirt structure by filament winding multiple hoop layers over hand lay-up fabric.

In another embodiment of the invention, the method comprises the steps of preparing a soluble mandrel on which a liner shell is to be fabricated, the mandrel having body shaped to pattern an interior of the pressure vessel, and including an end fitting protruding from the tool body at a location of a desired opening in the pressure vessel, laying up plies of composite material over the soluble mandrel in multiple layers that cover the mandrel completely but leave the end fitting protruding through the layers of composite material, curing the liner shell to form a rigid structure in the shape of the vessel, mounting a boss having an aperture therethrough on the outer surface of the shell with the aperture disposed adjacent the desired opening in the pressure vessel, overwrapping the liner shell and mounted boss but not the aperture with wound filaments impregnated with matrix material, and curing the over wrapped liner shell and mounted boss.

It will be appreciated from the foregoing summary that the present invention represents a significant advance in the field of pressure vessel fabrication for cryogenic, space and other applications. In particular, a vessel formed by overwrapping a composite liner shell with additional composite material has relatively low weight and low cost. Other aspects and advantages of the invention will become apparent from the following more detailed description, taken in conjunction with the accompanying drawings.

BRIEF DESCRIPTION OF THE DRAWINGS

Referring now to the drawings in which like reference numbers represent corresponding parts throughout.

DETAILED DESCRIPTION OF PREFERRED EMBODIMENTS

Figure 1:
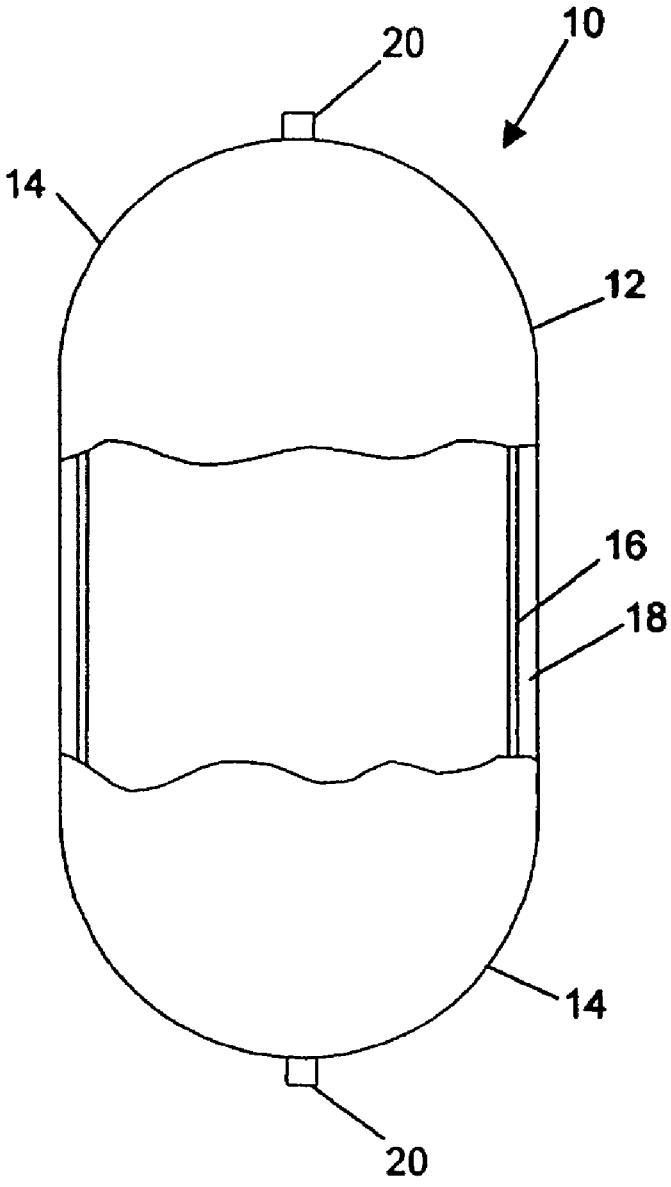
FIG. 1 is a diagrammatic view of a pressure vessel constructed in accordance with the invention.

In the following description, reference is made to the accompanying drawings which form a part hereof, and which is shown, by way of illustration, several embodiments of the present invention. It is understood that other embodiments may be utilized and structural changes may be made without departing from the scope of the present invention.

As shown in the drawings for purposes of illustration, the present invention pertains to pressure vessels for use in applications in which weight, cost, or both are important concerns. Although the invention was made with launch vehicle propellant tanks and other space vehicle applications in mind, it may also be usefully applied in other fields. In the past, pressure vessels of this general type have been made to include a metal liner, or have been made in part from composite materials that must be cured the controlled temperature and pressure environment of an autoclave.

In accordance with the present invention, a pressure vessel is formed to include an inner shell of a composite material, which is then filament wound with an outer composite structure and cured out-of-autoclave. Most pressure vessels are either spherical or cylindrical in shape. The one described here by way of example is cylindrical with domed, geodesic, iso-tensoid dome profiles. However, for convenience of illustration the dome profiles are shown in the drawings as hemispherical. Thus, as shown in FIG. 1, the tank, indicated generally by reference numeral 10, has a generally cylindrical body 12 and two end domes 14. As shown only diagrammatically, and not to scale. The tank 10 includes an inner or liner shell 16 of composite material and a filament wound outer structure 18, also of composite material. As will be described in detail below, the liner shell 16 is formed as two practically identical halves and later joined at the midpoint of the length of the cylindrical body 12. Boss end fittings 20 are bonded at the center of each dome 14 before the halves of the inner shell are joined. Each boss fitting 20 provides an opening through which fluids are placed in or removed from the tank 10, and may include a threaded end portion to engage a sealing cap or pipe coupling (neither of which is shown). The boss fittings 20 may be of aluminum or another suitable metal, or may themselves be of a composite material.

The remaining figures depict the fabrication steps performed in accordance with the present invention as described below. It will, be understood, of course, that the specific steps and materials used are disclosed for purposes of illustration only.

Figure 2:
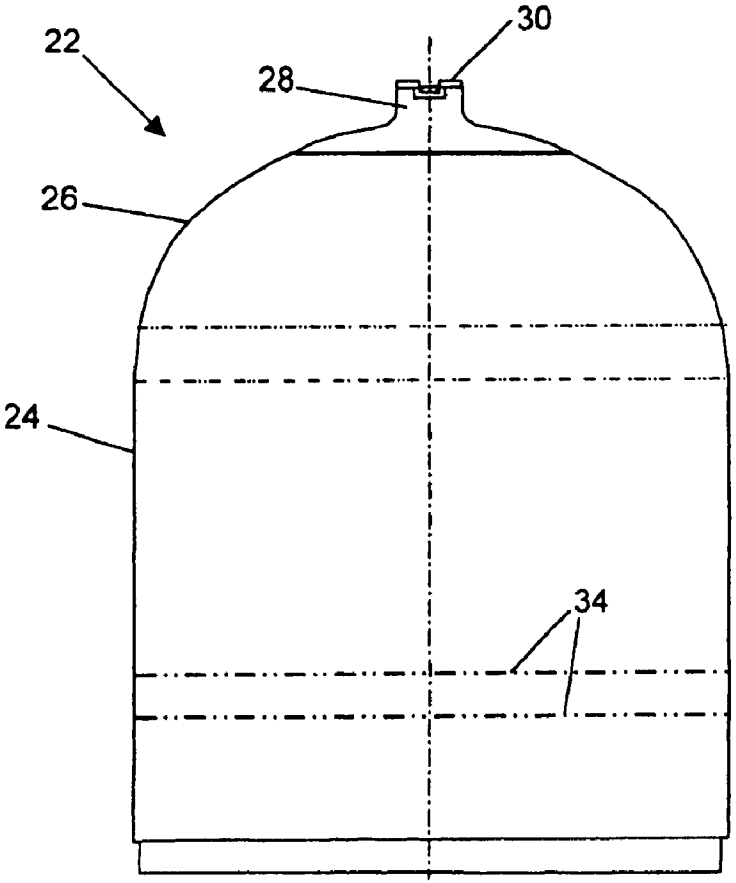
FIG. 2 is an elevational view of a tool for fabricating a half portion of a liner shell in accordance with one aspect of the invention.

(1) Preparation of Layup Tool:

The liner shell 16 is fabricated by hand layup or wrapping of composite material over two male layup tool halves, one of which is shown at 22 in FIG. 2. Alternatively, a single layup tool (not shown) could be used to form the whole liner shell 16 as one piece. However, because the method of the invention as presently contemplated requires that the bosses 20 be installed from the inside of the liner shell 16, the shell formed over a single layup tool would need to be cut in half after layup and curing. Each tool half 22 includes a cylindrical body 24 and an integral dome 26, with a metallic end fitting 28 connected to the dome. The metallic end fitting 28 includes a projecting stud 30 and an annular flange 32 that conforms with the inner surface of the dome 26. The same tool 22 may be used in the fabrication of tanks of various sizes, by terminating layup at a selected point on the cylindrical body 24, as indicated by broken lines 34. Tool removal is further facilitated by the application of wax or another mold release coating on the tool surface before layup begins.

Figure 3:
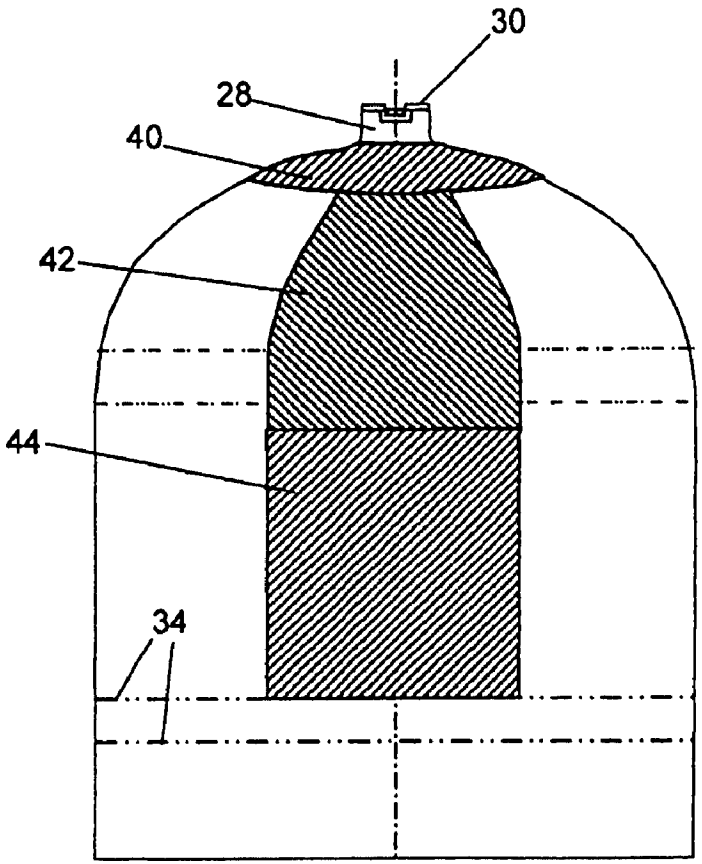
FIG. 3 is a view similar to FIG. 2, but showing the geometry of the hand lay-up fabric around the polar end fitting, the dome, and the cylindrical portions of the vessel.
Figures 4, 5:
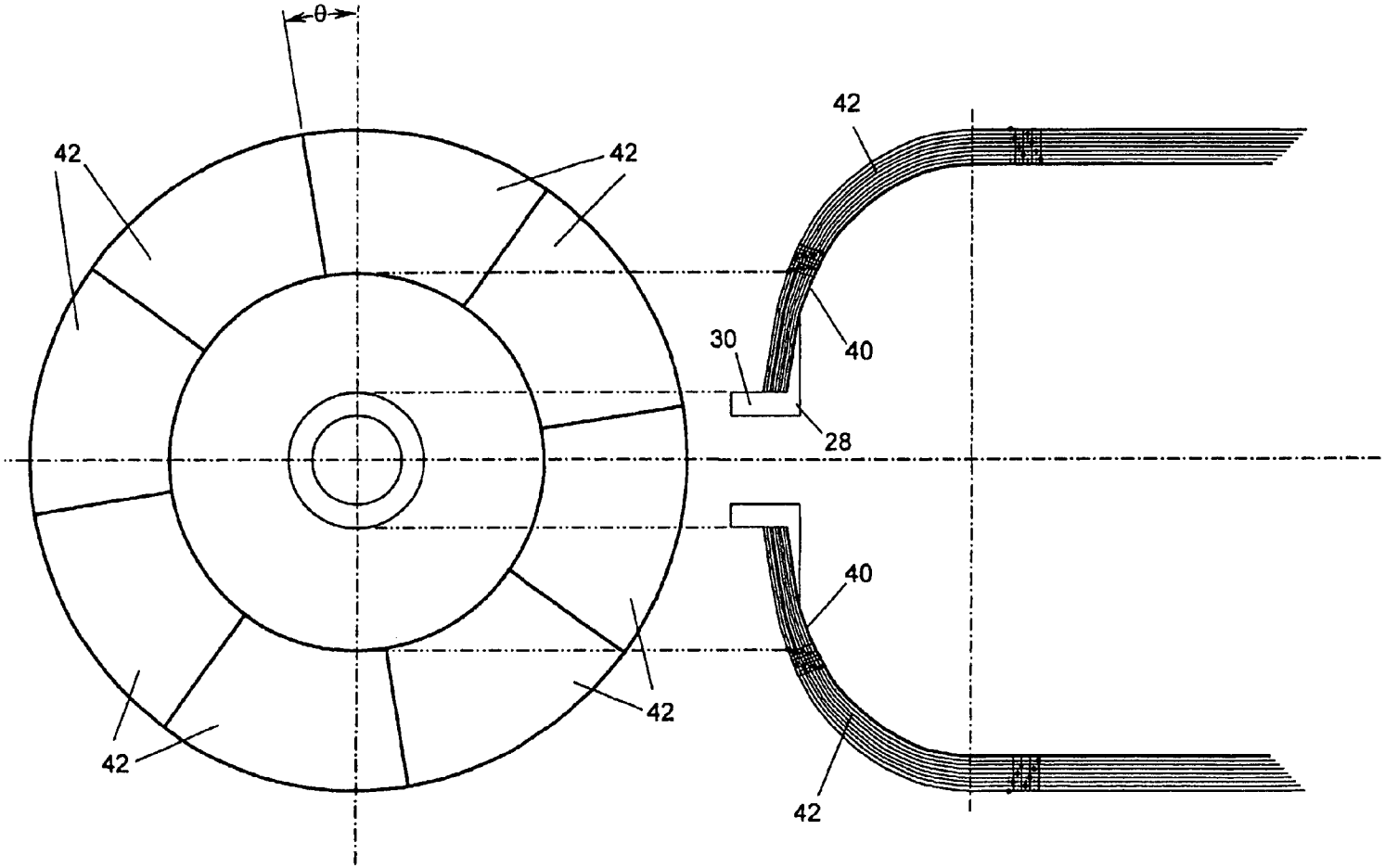
FIG. 4 is a top plan view of the liner shell half portion, showing the arrangement of fabric around the polar end fitting and the dome.
FIG. 5 is a cross-sectional cut corresponding to FIG. 4, showing eight ply layers laid on the tool.

(2) Liner Shell Layup Process:

Although the hand layup process is described here, it will be understood that a machine wrapping process may be used with equivalent results. As shown in FIG. 3, each layer or ply of material is laid on the tool in accordance with a specific layup schedule. Because of the surface curvature of the liner shell 16, fabric for fabricating the liner shell was cut using three different patterns. "Doily" pattern 40 was used around the boss end fitting 20. "Field" pattern 42 was used around the dome and the dome-cylinder interface. "Cylinder" pattern 44 was used around the cylinder. All of the patterns are cut from flat fabric, such as selected fiberglass or graphite fabric. Doily pattern 40 is annular in shape, with a central hole to permit placement over the stud 30 of the metallic end fitting 28. Cylinder pattern 44 is rectangular in shape and is used only on the cylindrical body 24 of the tool 22. Field pattern 42 is of irregular shape, as further described below, and is used in the dome portion 26 of the tool 22. In the illustrated layup process, each layer is made up of eight adjoining cylindrical pattern sections encircling the cylindrical body 24 of the tool 22, and a tier of eight field pattern sections adjoining the cylindrical sections. The layer also includes a single doily pattern section butted against the edges of the eight field sections. FIG. 4 is an end view of the laid-up liner shell 16, showing a doily pattern section 40 and eight field pattern sections 42. FIG. 5 is a cross-sectional view of a portion of the laid-up liner shell 16, showing the metal end fitting 28 and showing that there are eight layers in all.

Figure 6:
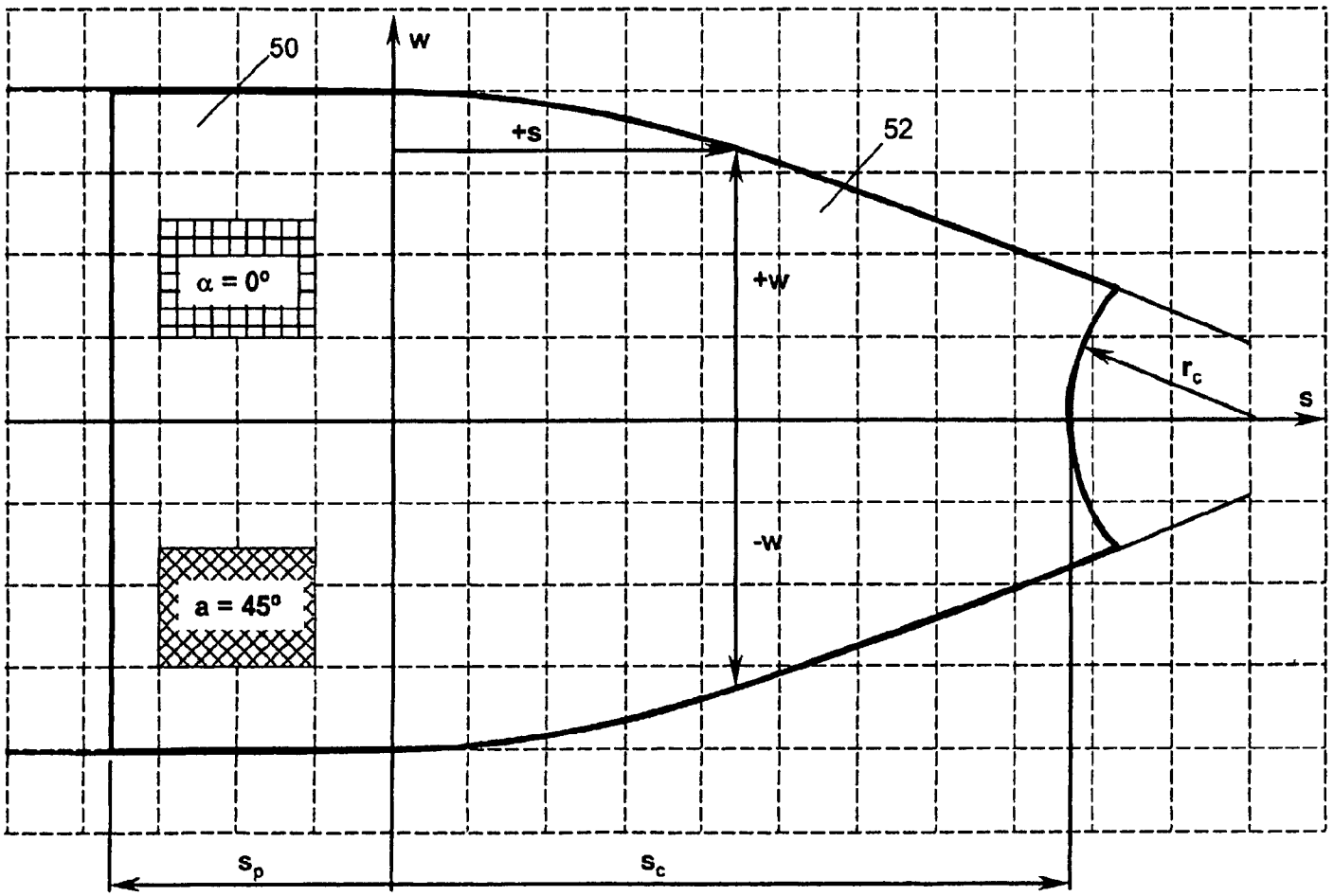
FIG. 6 is a diagram of a template for cutting field pattern sections for the inner shell.

FIG. 6 is a plan view of a template for a field pattern section 42. The field pattern template is symmetrical about a longitudinal axis 's' and has a half-width 'w' that is predefined for each ordinate in the s-axis direction. The field pattern template includes a lower section 50 with parallel side edges and a length $s_p$ measured in the s-axis direction, and an upper section 52 with convexly curved side edges and a length $s_c$ measured in the s-axis direction. The lower sections 50 abut over the cylindrical section 24 of the took 22 and form the upper cylindrical section 24 of the liner shell. The upper sections 52 abut over the dome portion 26 of the tool 22. The lower portion 52 of the pattern includes a concave arcuate edge of radius $r_c$ selected to form a circular edge with adjacent field pattern sections 42. The specific width, length and radius measurements of each field pattern section are selected to provide abutting sections when laid up on the tool 22. The ply fiber direction in the eight plies 42 is alternated between 0" and 45" with respect to the s axis, for successive pairs of layers. That is, the fiber angle is 0° for plies #I and #2, 45° for plies #3 and #4, 0° for plies #5 and #6, and 45° for plies #7 and #8.

Figure 7:
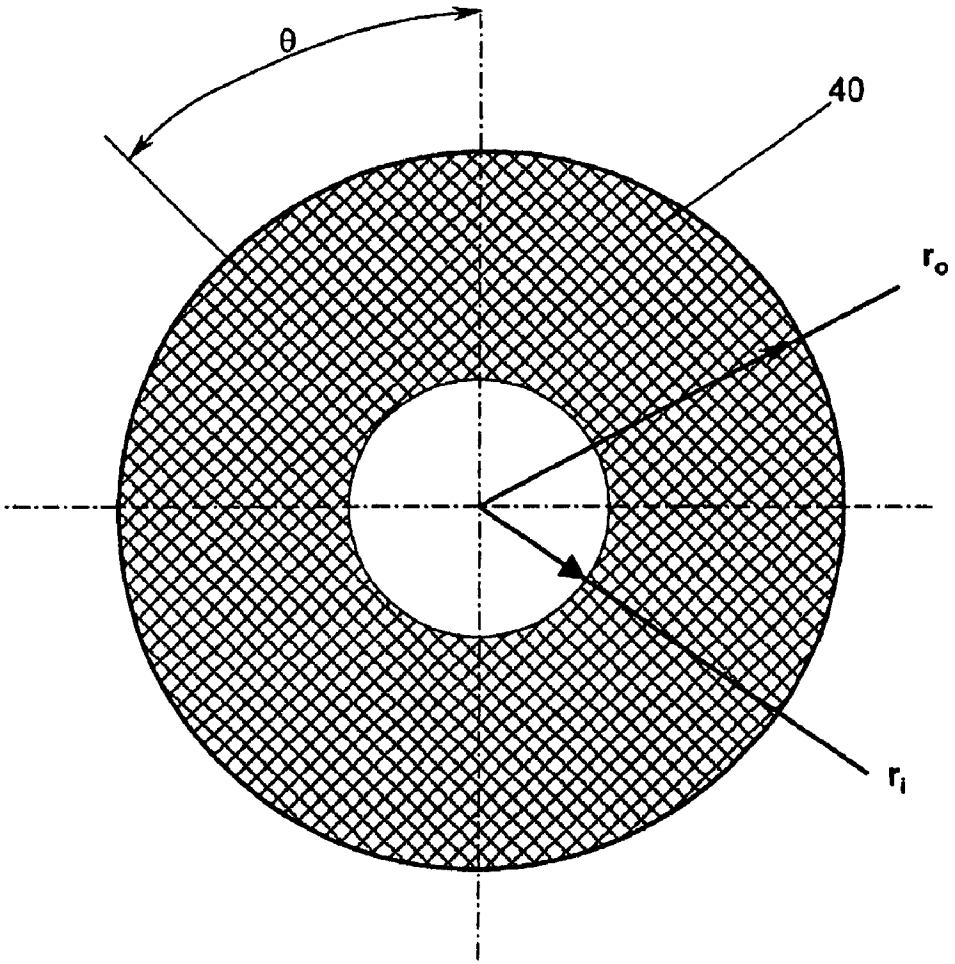
FIG. 7 is a diagram of a template for cutting doily pattern sections used around the polar end fitting on the liner shell.
Figure 8:
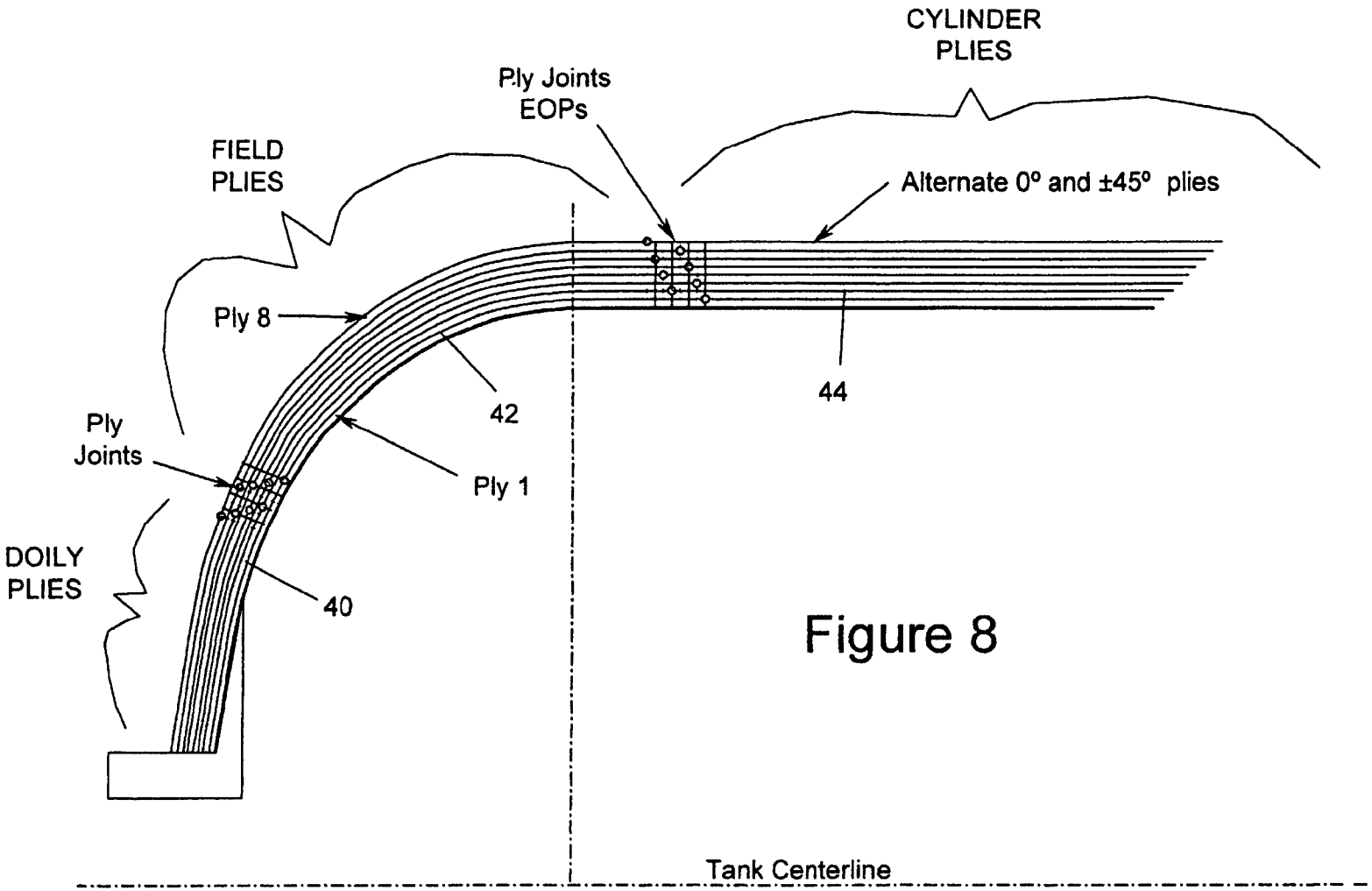
FIG. 8 is a fragmentary cross-sectional cut showing how ply joints are stepped and staggered.
Figure 9:
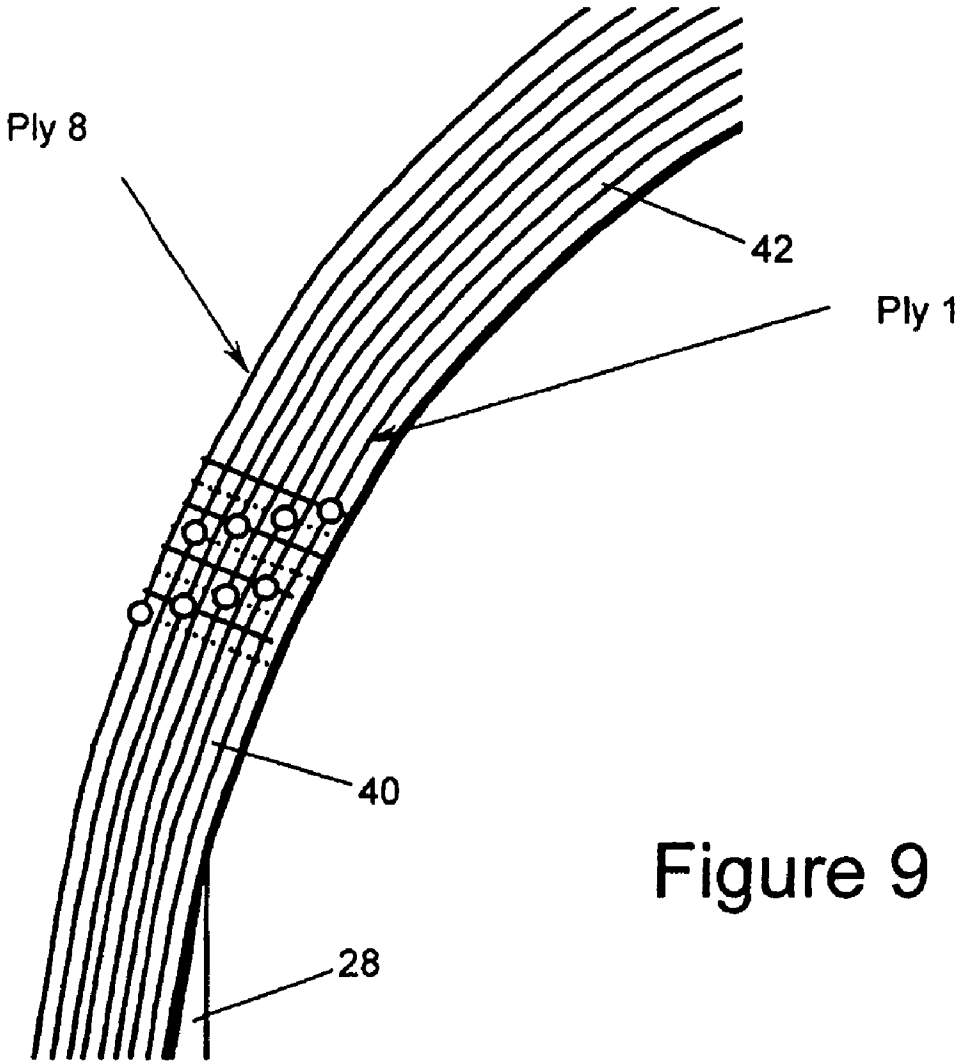
FIG. 9 is an enlarged and cross-sectional cut similar to FIG. 8, showing how adjacent ply joins are stepped and staggered.

FIG. 7 is a plan view of a template for a doily pattern 40, the shape of which is annular, having an outer radius $r_o$ and an inner radius $r_i$, which are defined in accordance with a lay-up schedule for a specific tank size. FIG. 8 depicts how multiple layers of doily sections 40, field sections 42 and cylinder sections 44 are laid up on the tool 22. The lay-up sequence includes the steps of: (1) laying up the doily section 40, (2) laying up eight field section segments 42 butted to the doily section and butted to each other, with the last segment trimmed to fit, (3) laying up eight cylinder section segments 44 butted to the field section segments and to each other, with the last segment trimmed to fit, and (4) repeating the foregoing steps to apply a total of eight layers. The section segments are precisely dimensioned to provide section joints that are both stepped and staggered, as best shown in FIG. 9, which depicts the joints between eight layers of doily sections 40 and eight layers of field sections 42. Butt-jointed edges of plies in the first and other odd-numbered layers are offset or staggered with respect to the edges of plies in the second and other even-numbered layers. In addition, the butt joints of the odd-numbered layers are stepped with respect to each other, i.e., they are positioned at successively spaced positions. As a result, a butt joint on any one layer completely covered by at least one ply above or the joint. Butt joints in middle layers, i.e., not the first and last layers, are completely covered by plies both above and below the joint.

After lay-up of all eight-ply layers is complete, the liner shell is cured with heat lamps.

Figures 10A, 10B, 10C:
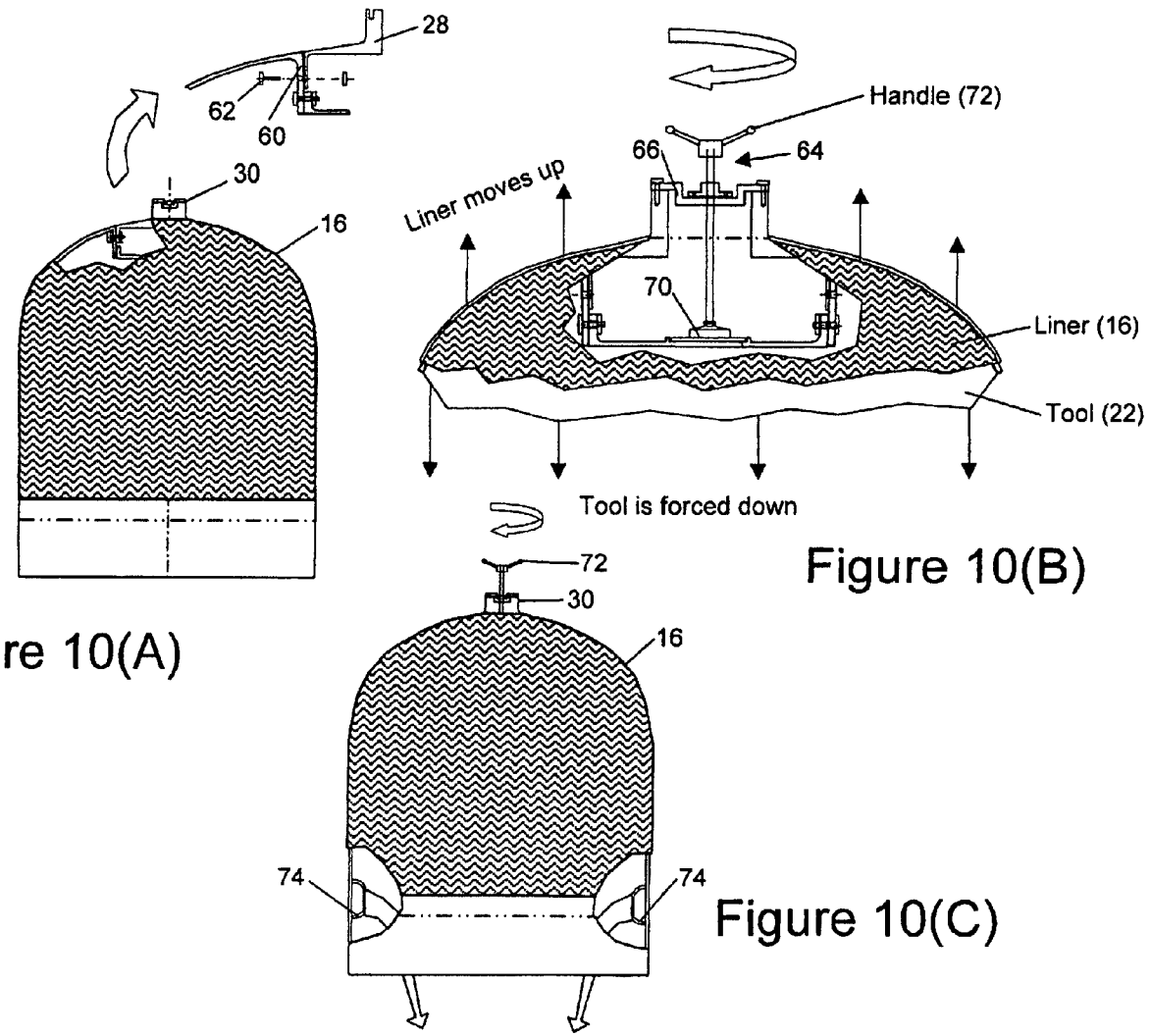
FIGS. 10A, 10B and 10C are diagrammatic views depicting how the tool is removed from the liner shell.

(3) Separation of Tool from Liner Shell:

As best shown in FIG. 10A, the metal end fitting 28 was joined, prior to fabrication of the liner shell, to a flange 60 inside the tool 22 by fasteners 62. As a first step in removing the tool 22 from the liner shell 16, the fasteners 62 are removed. Then, as shown in FIG. 10B, a tool removal assembly 64 is installed. The assembly 64 includes an end cap 66 that is secured to the top of the metal end fitting 28, a threaded rod 68 extending through a central hole in the end cap 66, and an end plate 70 secured to the lower end of the rod 68. The end plate 70 impinges on a surface of the tool 22. When an operating handle 72 at the top of the threaded rod 68 is rotated, the end plate 70 applies downward force on the tool 22 and an upward force on the metal end fitting 28. This action tends to loosen the liner shell 16 in the dome area. Simultaneously, as shown in FIG. 10C, the tool 22 is pulled downward and inward by handles 74, separating the cylindrical sides of the tool 22 from the sides of the liner shell 16 and facilitating complete removal of the tool. Finally, the assembly 68 and the metal end fitting 28 are removed from the liner shell 16.

Figure 11:
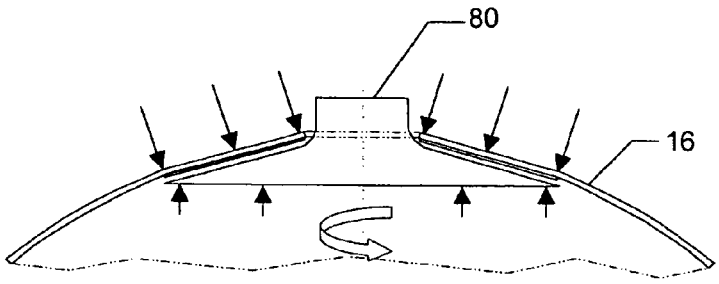
FIG. 11 is a cross-sectional cut depicting installation of a polar fitting in an opening through the liner shell.

(4) Preparation of Liner Shell for Polar End Fitting Installation:

After removal of the tool 22, the innermost layer of the liner shell 16 is checked for voids or porosity, and the cylindrical edge of the liner shell is trimmed to match the dimensions needed for the applicable tank length. As shown in FIG. 11, the next step is to dry-fit a tank end fitting 80 to the liner shell 16 in the cut-out area formerly occupied by the metal end fitting 28. The end fitting 80 must seat smoothly against the liner surface and not bind in the opening. The area at which the fitting 80 contacts the innermost layer of the liner shell 16 preferably includes a peel ply that can be removed at this point in the process to provide a good bonding surface for the boss. The bonding surface of the fitting, if of aluminum, is scuffed with an 80-120 grit sand paper, and both surfaces are cleaned with a solvent such as acetone, to ensure that the both surfaces are clean. Threaded holes of the end fitting 80 are covered with tape for protection.

(5) Bonding of End Fitting into Liner shell:

The end fitting 80 such as a boss can be fitted to the liner shell 16 in a variety of ways. In one embodiment, the end fitting 80 is fashioned of a suitable metal such as aluminum. A suitable adhesive, such as two-part epoxy (e.g. DEXTER HYSOL EA9361) is mixed and applied as a smooth, thin layer to the innermost layer of the liner shell 16 over the annular area where the boss 80 is to be installed. The preferred thickness of the layer of adhesive may depend upon the strength and environmental requirements of the completed pressure vessel. The end fitting 80 is inserted until contact is made with the adhesive layer, then rotated slowly to ensure good contact, while applying pressure to allow any trapped air to escape through holes (not shown) in the flange of the end fitting 80. Entry of adhesive into the holes provides improved adhesive contact. Any excess adhesive is smoothed around the periphery of the end fitting 80 to leave a smooth interface. Finally the adhesive is cured while maintaining pressure on the end fitting 80 to ensure a void free adhesive interface.

Figure 12A:
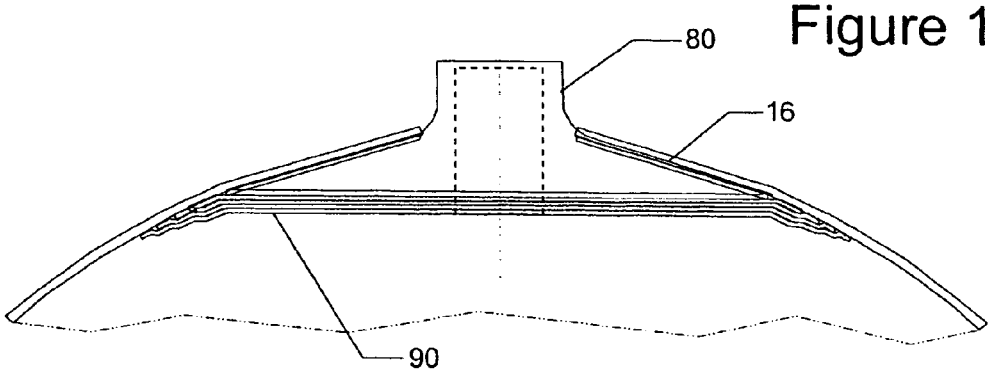
FIG. 12A is a cross-sectional cut depicting the installation of doubler plies to strengthen the end fitting-to-liner interface.
Figure 12B:
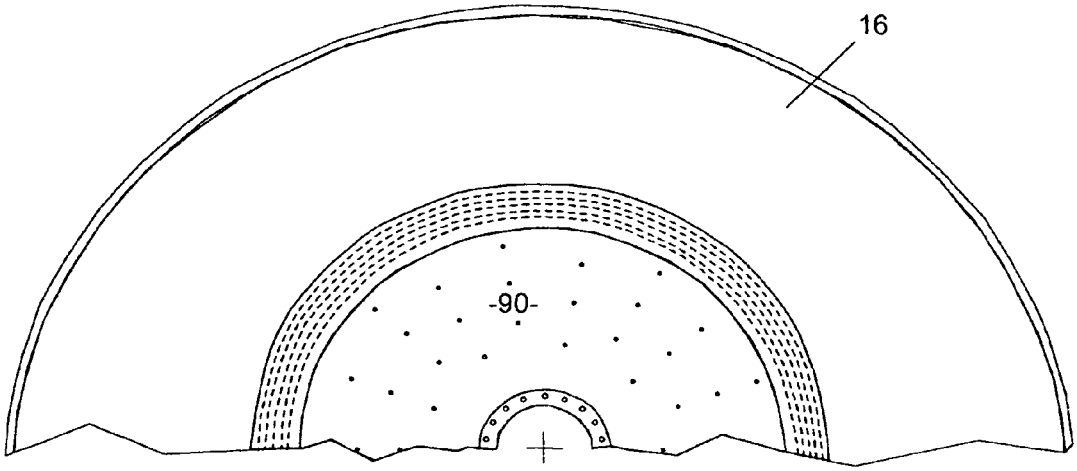
FIG. 12B is a fragmentary bottom plan view corresponding to FIG. 12A.

(6) Boss Doubler Ply Fabrication Process:

As shown in FIGS. 12A and 12B, annular end fitting doubler plies 90 are applied successively to sandwich end fitting flange 80 between the doubler plies 90 and the liner shell 16, thus forming a double-lap shear joint. Preferably, each new ply 90 is larger in outer diameter than the previously applied one, and provides a radial overlap of about a centimeter or more. The doubler plies 90 are of the same material as the liner shell 16. The ply fiber direction may be alternated between 0° and 45° from one ply layer to the next.

Figure 12C:
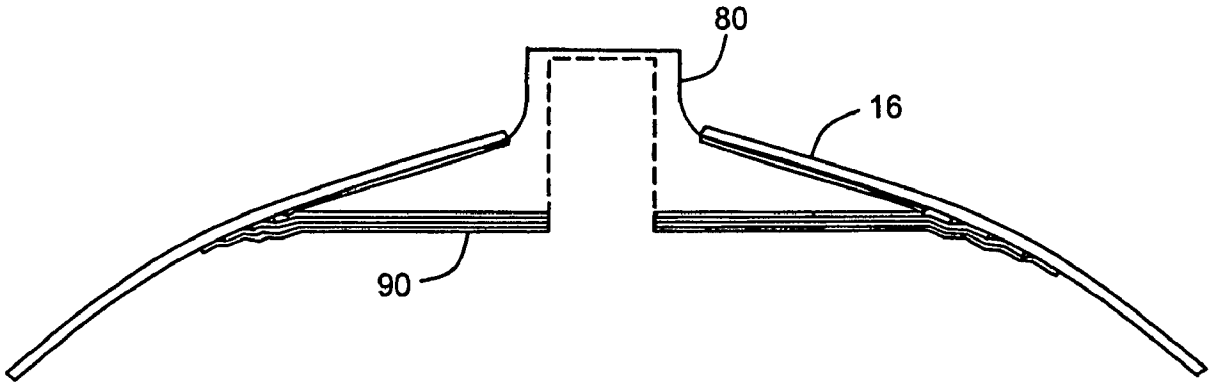
FIG. 12C is a diagram showing a cross section of the assembly after plies are applied to the end fitting.
Figure 12D:
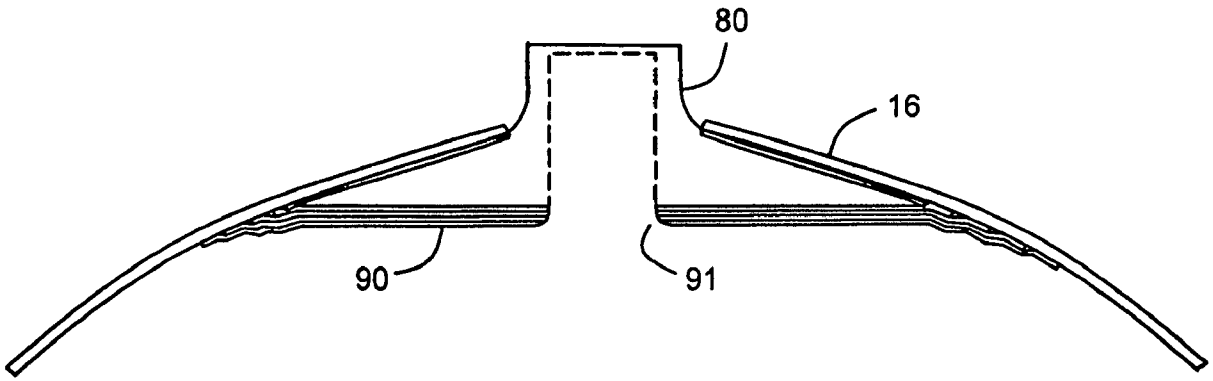
FIGS. 12D-12E illustrate another embodiment of the end fitting attachment
Figure 12E:
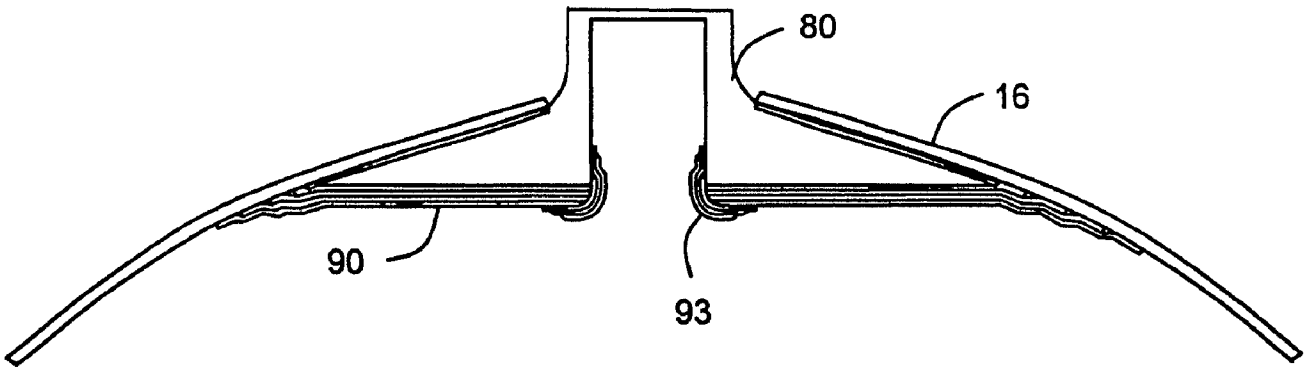

FIG. 12C is a diagram showing a cross section of the assembly after plies 90 are applied to the end fitting 80. A potential direct gas pressure leak path between the bottom surface of the end fitting 80 and the plies 90 is exacerbated by the right angle orientation of the plies 90 at the open end of the end fitting 80. FIGS. 12D-12E illustrate another embodiment of the end fitting 80 attachment. Referring first to FIG. 12D, after the boss 80 has been installed and the annular end fitting doubler plies 90 are applied, the doubler plies 90 are abraded or otherwise prepared to a rounded shape 91. Then, as shown in FIG. 12E, an additional layer of composite material 93 laid up along the interior surface rounded shape 91 using the same techniques as described above.

Figures 13A, 13B, 13C:
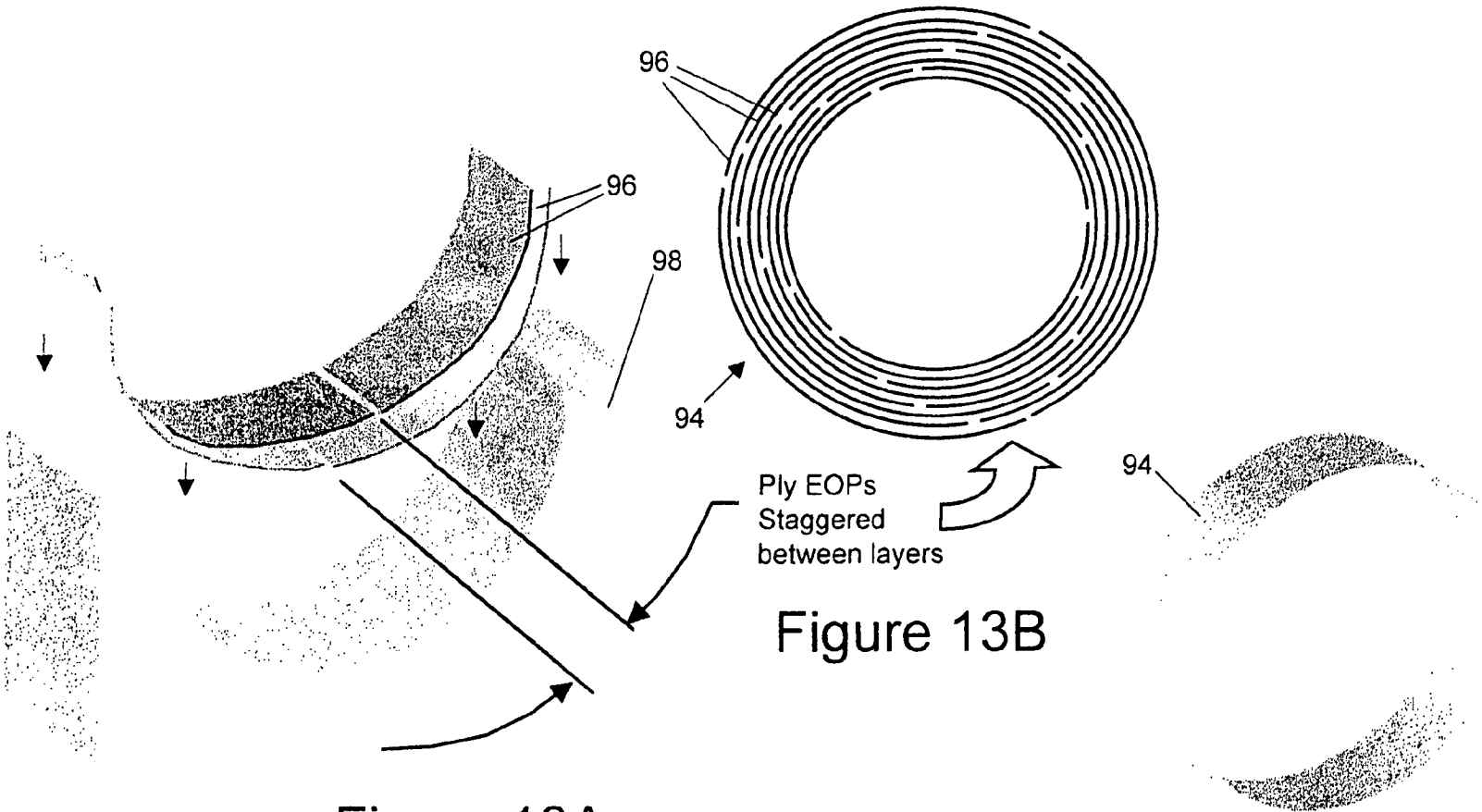
FIG. 13A is a diagrammatic perspective view showing fabrication of an inner bellyband.
FIG. 13B is a diagrammatic end view of the inner bellyband, showing the locations of ply joints.
FIG. 13C is a perspective view of the completed inner bellyband.

(7) Internal Bellyband Fabrication Process:

As shown in FIGS. 13A-13C, an internal bellyband 94 is fabricated by laying up eight plies 96 of material on the inside of a cylindrical tool 98, only half of which is shown. Each of the plies 96 comprises three strips that are butt-jointed to form a continuous band, and the butt joints are staggered circumferentially such that no two joints occur at or near the same location. The ply fiber direction is alternated between +45° and −45° from layer to layer. The completed bellyband 94 preferably includes a final peel ply and is cured at room temperature. The ply material may be, for example, 6781 Style S2 glass fiber fabric.

Figure 14C:
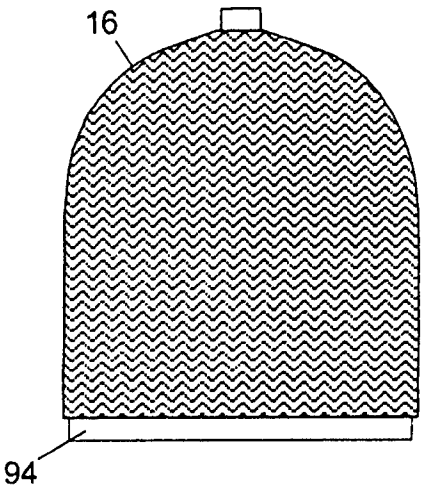
FIGS. 14A, 14B and 14C are diagrammatic views depicting installation of the inner bellyband in a liner half portion.
Figure 14B:
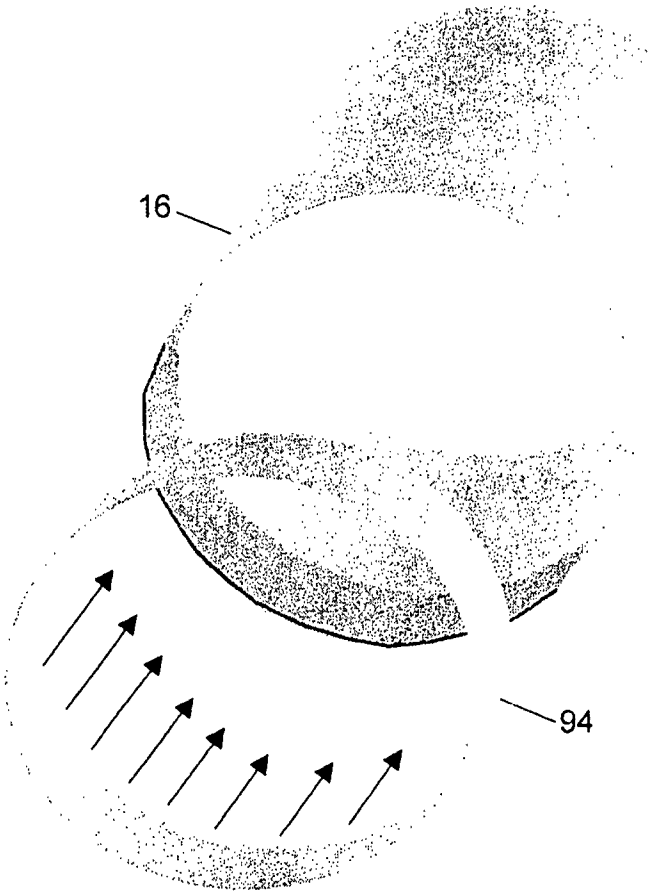
Figure 14A:
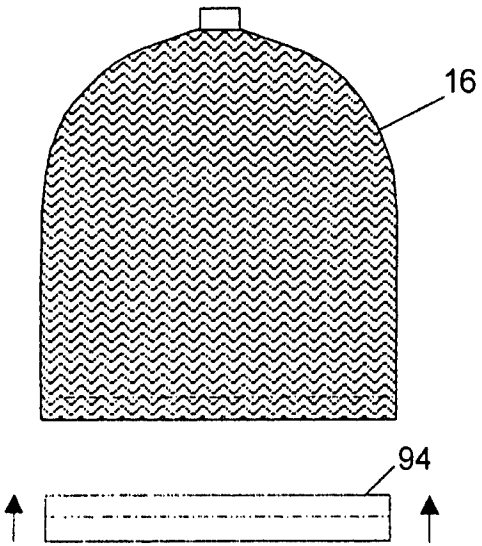

(8) Bonding Internal Bellyband into First Liner Half:

As shown in FIGS. 14A-14C, the bellyband 94 is first dry-fitted into one half of the liner shell 16. The innermost layer of the liner shell 16 is scuffed with sandpaper and the outermost layer of the bellyband 94 is similarly treated, unless a peel ply was used before the first ply was applied to the tool during fabrication. Both surfaces are then cleaned with a solvent, such as denatured alcohol, and a layer of adhesive, such as Dexter Hysol EA9361, is applied to the innermost layer of the liner shell 16 half over the area of contact with the bellyband 94. The bellyband is then inserted into the liner shell with a rotational motion, until half of its width is covered by the liner. The joint is then cured, leaving the installed bellyband as shown in FIG. 14C.

Figure 15B:
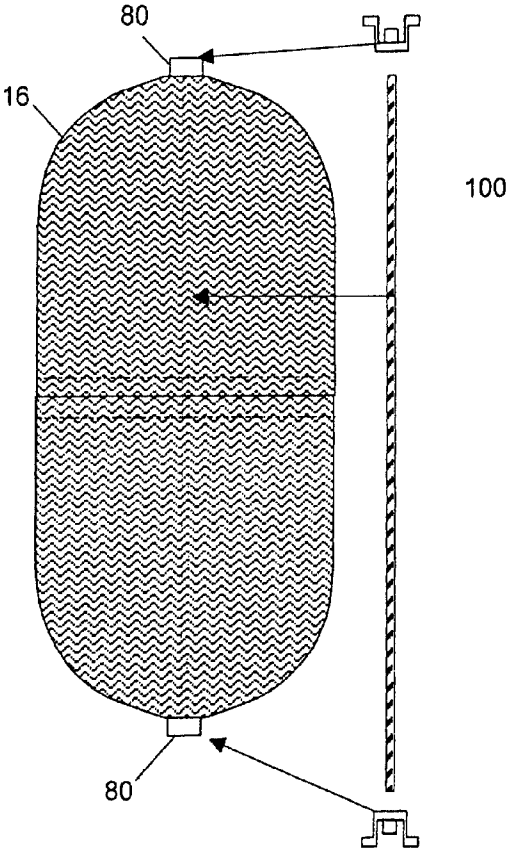
FIGS. 15A and 15B are diagrammatic views depicting assembly of the two half portions of the liner shell.
Figure 15A:
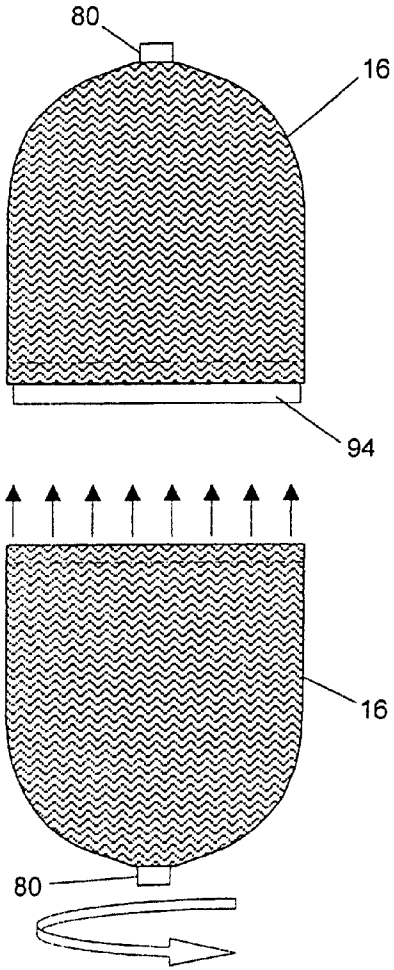

(9) Bonding Liner Halves Together:

As shown in FIG. 15A, the two halves of the liner shell 16 are assembled by first preparing the innermost surface of the second half and the outermost surface of the bellyband, by scuffing with sandpaper and cleaning with alcohol. Adhesive such as Dexter Hysol EA9361 is applied to the innermost layer of the second half, and the two halves are engaged with a rotational motion. The assembled liner shell 16 is cured in a vertical position, as shown in FIG. 15B, using a clamp assembly 100 that extends through the two bosses 80 and applies positive pressure to clamp the halves together during curing. The same adhesive is preferably applied as a leak barrier to the innermost surfaces of the two halves prior to bonding the two together. Film layers have been used in the past, especially for cryogenic tanks, but the use of a two-part adhesive simplifies fabrication and is at least as reliable as a film liner.

Figure 16A:
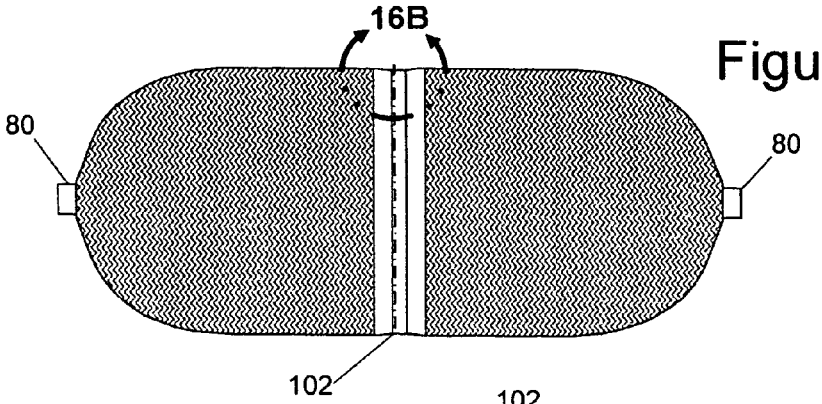
FIG. 16A is a diagrammatic view of the assembled liner shell with a circumferential groove formed for an outer bellyband.
Figure 16B:
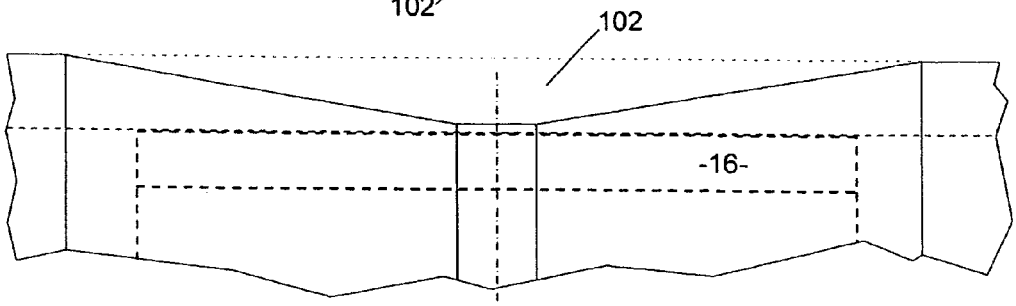
FIG. 16B is an enlarged, cross-sectional cut showing the groove formed for an outer bellyband.

(10) Preparing Liner and Applying Outer Bellyband:

As shown in FIGS. 16A and 16B, the joint seam between the two halves of the liner shell 16 is prepared by tapering the outermost layer to form a shallow V-shaped groove 102 over the seam. In forming this groove 102, the outermost layer is sanded or machined through almost its entire thickness at the seam.

Figure 17:
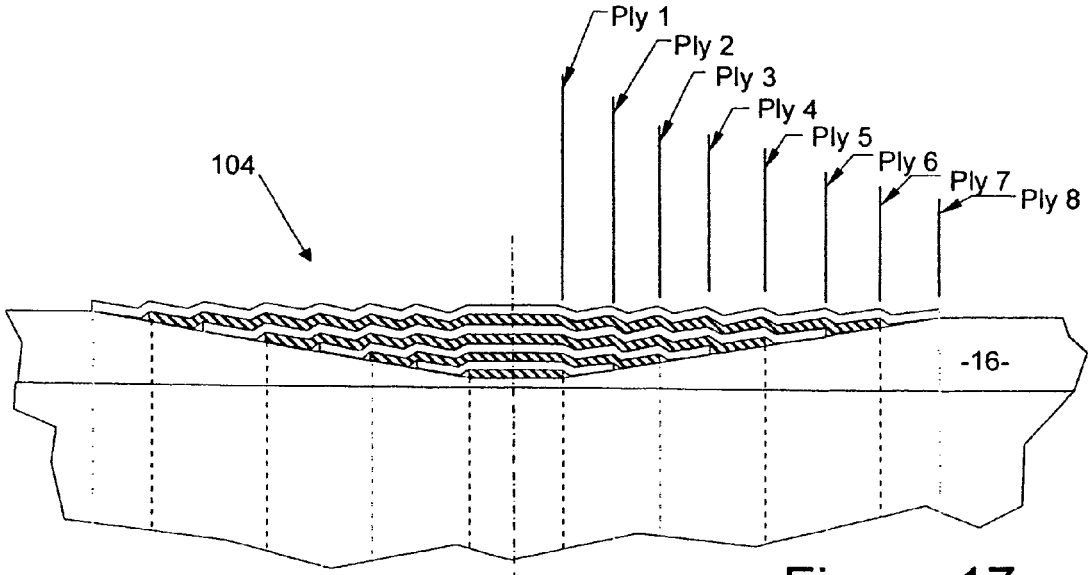
FIG. 17 is a diagrammatic cross-sectional view showing how eight plies are employed to form the outer bellyband.

As shown in FIG. 17, an outer bellyband 104 is formed by applying eight plies of successively greater width to the groove 102. The ply fiber direction is varied from ply to ply. For example the eight successive plies may have fiber angles of 0°, 0°, +45°, −45°, 0°, 0°, +45°, and −45°, respectively. The ply material may be, for example, of fiberglass cloth, such as 6781 Style S2 glass fiber fabric. The ply thickness values are preferably chosen such that the final ply application will result in a one-ply excursion beyond the nominal outermost layer of the liner shell 16. Then, a peel ply is applied to the bellyband 104 and the assembly is cured at room temperature until tack free. Finally, heat is applied, up to 170° F. for six to eight hours for a final cure. After curing, any remaining peel ply material is removed from the outermost layer and the surface is checked for notable signs if dryness, porosity or other non-conformities.

Figure 18:
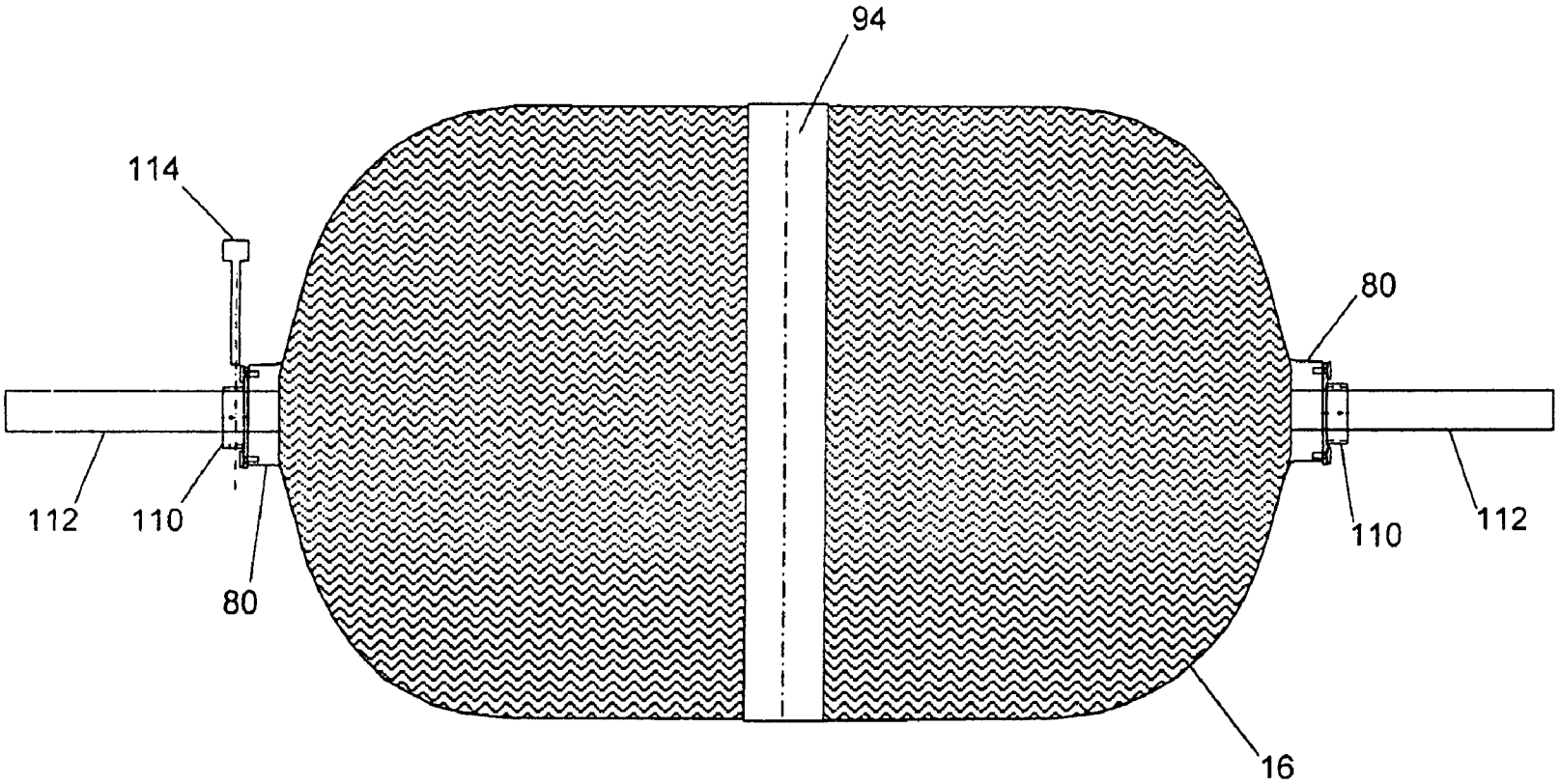
FIG. 18 is a diagrammatic view of the completed liner shell mounted on winding shaft.
Figure 19:
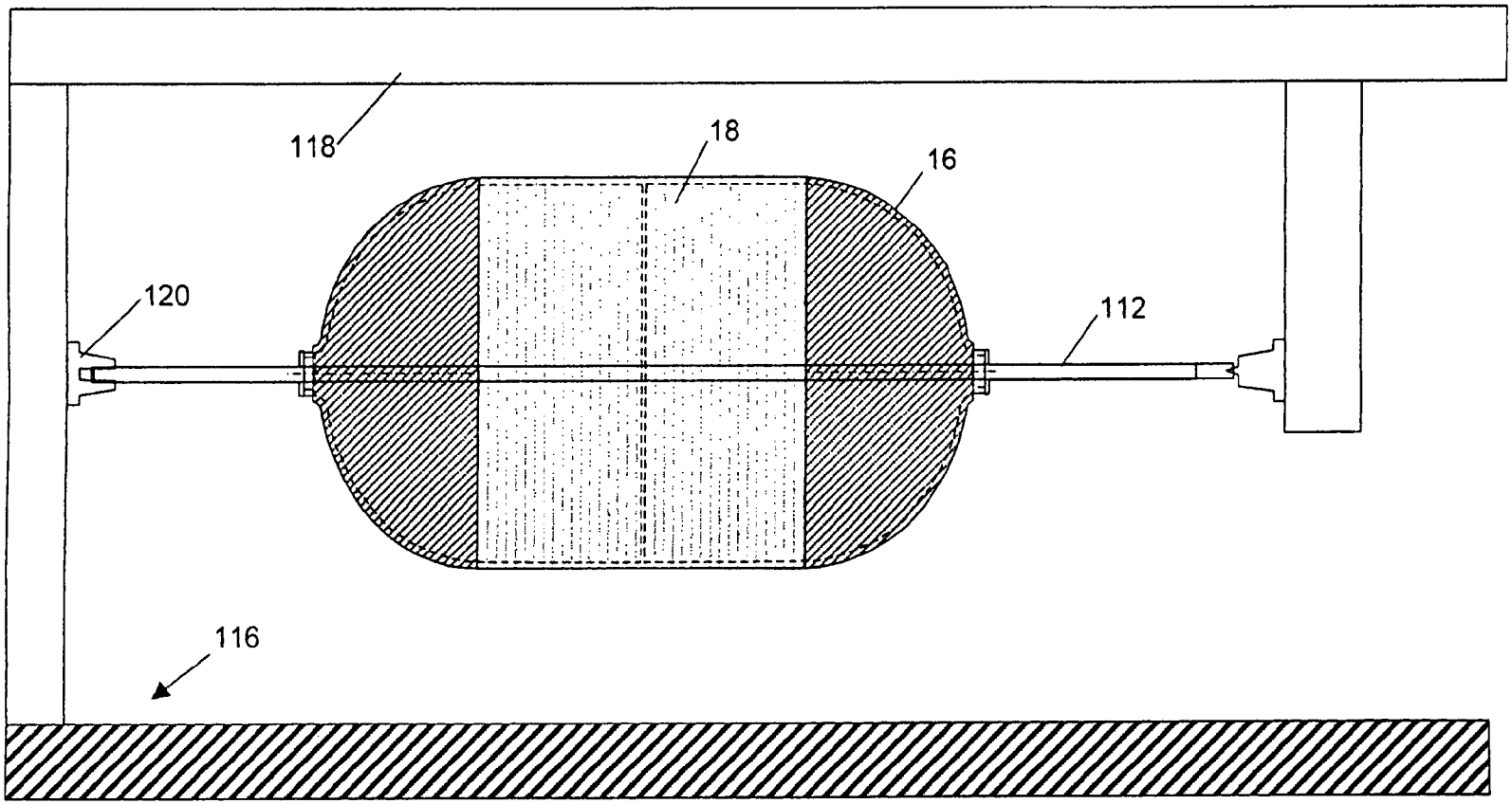
FIG. 19 is a diagrammatic view of the completed liner shell and its winding shaft mounted on a winding machine.

(11) Overwrapping of Liner:

(a) Preparation: As shown in FIG. 18, a tank collar 110 is mounted on each of the bosses 80, and a bolt 112 is inserted through the collars, extending from each end of the liner shell 16. A locking bolt 114 secures the tank collar 110, and with it the liner shell 16, to the bolt 112 at one end thereof. This end is coupled to the drive side of a winding machine 116, as shown in FIG. 19. The machine 116 includes a rigid frame 118 and a driven three-jawed chuck 120 for gripping the bolt 112 and rotating the liner shell for the wrapping operation.

Figure 20:
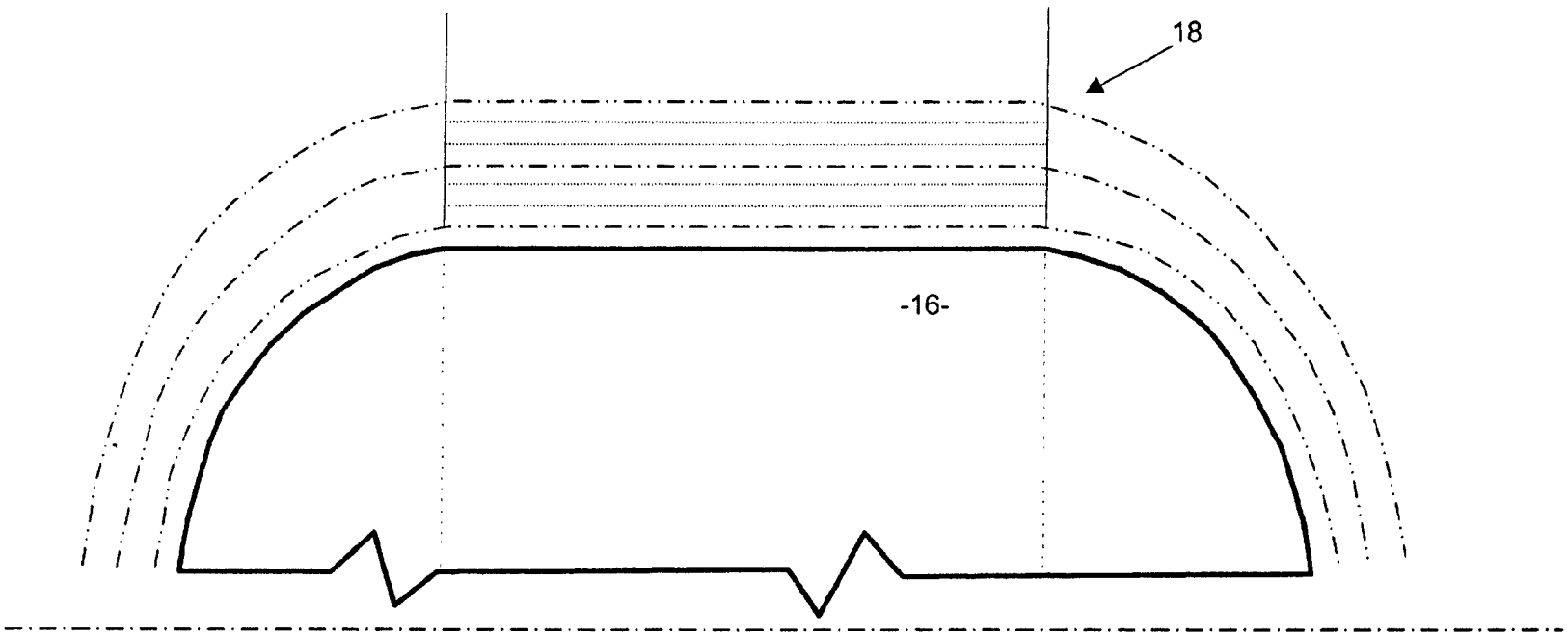
FIG. 20 is a diagrammatic cut showing the basic tank winding schedule for overwrapping the liner shell.

(b) Basic Wrapping: As shown in FIG. 20, the liner shell 16 is filament wound with additional layers of composite material to satisfy the desired strength and stiffness requirements of the vessel. The winding schedule shown by way of example includes three helical layers shown by the broken lines with dots and dashes (-••-••-••), and hoop or circular layers shown by dotted lines (••••••). The helical layers are applied at an angle of 13.3° to the axis of the liner shell 16 and extend over the entire surface of the liner shell 16, including the cylindrical and domed portions. Each helical layer uses twenty-four tows of material simultaneously and makes ninety circuits of the liner shell 16. A first helical layer is followed by two of the hoop layers, extending only across the cylindrical portion of the liner shell 16. A second helical layer follows these, and then another two hoop layers are applied. A third helical layer follows, and then a final two circular layers. This configuration results in a dome thickness of a little more than half the thickness of the cylindrical portion, because the hoop layers cover the cylindrical portion only. Both the hoop and helical layers may, for example, use carbon tows such as 12K IM7, with twenty-four tows in each bandwidth.

Figure 21:
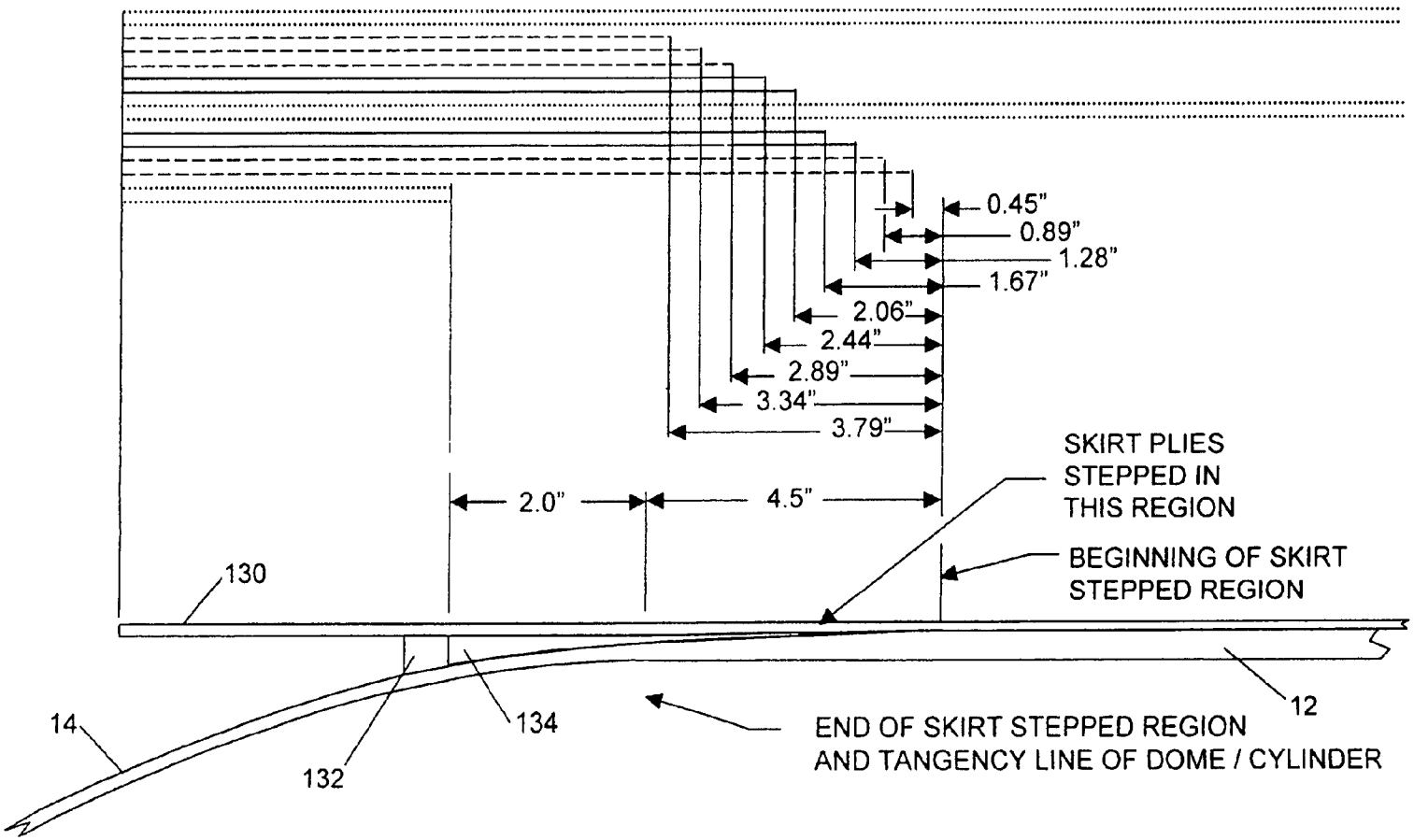
FIG. 21 is a diagrammatic cut showing the winding schedule and adhesive shear ply y-joint for the composite skirts on the pressure vessel.

(c) Skirt Lay-Up: After the basic overwrapping described above an additional wrapping step is performed to fabricate a skirt 130 at the each end of the structure, as depicted in FIG. 21. Each skirt 130 is a continuation of the cylindrical body 12 of the tank 10 beyond the tangency line at which the cylindrical body 12 transitions into the end dome 14. The skirts 130 are used to support the tank 10 and also may be used as primary load carrying structural members. Therefore, the skirts 130 may support not only the weight of the tank and its contents, but as a primary structural member may react additional loading environments imposed on it during, for example, fabrication, shipping and handling, launch, and service life.

The skirts 130 are formed from laid-up plies of composite material, some of which are stepped to terminate near the tangency line between the dome 14 and the cylindrical body 12, and some of which extend from end to end of the two skirts. The layers wound to form the skirts are of three different types in the illustrative embodiment. First there are 90° degree hoop layers, such as 12K IM7 carbon tows, shown by the dotted lines. Then there are 0° unidirectional carbon layers, shown by the dashed lines, and finally there are carbon fabric layers, such as 282 Style Plainweave carbon, shown by the solid lines. The winding schedule calls for two hoop layers near the ends of the skirts 130, followed by two unidirectional carbon layers extending from the skirt ends to a point beyond the tangency line. These are followed by two carbon fabric layers, with each layer extending not as far as its predecessor beyond the tangency line, as shown in FIG. 21. Then two hoop layers are applied, extending the full length of the structure from one skirt end to the other. Next, the stepping continues with the application of two more carbon fabric layers and three additional unidirectional carbon layers, again with each successive layer extending not as far as its predecessor beyond the tangency line. Finally, two additional hoop layers are applied for the full length of the structure from one skirt end to the other. As an option, for example to save weight, the four hoop layers may be terminated a few inches beyond the end of the other layers and not extend the full length of the structure.

As depicted in FIG. 21, the junction between the tank 10 and the skirt 130 may be characterized as a Y-shaped joint, where the combined tank and skirt structures in the cylindrical region diverge apart to form the dome and the skirt. The skirt structure also includes an annular rubber dam 132 installed in the Y joint, between the skirt 130 and the outmost layer of the dome. The rubber dam 132 can be a custom-made or conventional O-ring chord. An annular space 134 in the Y joint, bounded by the tank dome, the skirt 130 and the rubber dam 132, is preferably filled with an appropriate adhesive prior to fabrication of the skirt. This construction is referred to as a shear ply. The shear ply, which is preferably cryogenically compliant, acts to prevent stress peaking at the shear joint between the skirt 130 and the body of the tank 10. A suitable two-part adhesive is Dexter Hysol EA9361.

(12) Further Alternative Embodiments

While the foregoing techniques permit the construction of a strong, leak proof tank or pressure vessel 10, they do require the fabrication of a liner shell 16 in two assemblies that are later fastened together. While the internal bellyband 94 and outer bellyband 104 achieve this purpose well, this joint may be eliminated by forming the liner shell 16 using a dissolvable mandrel.

Figure 22:
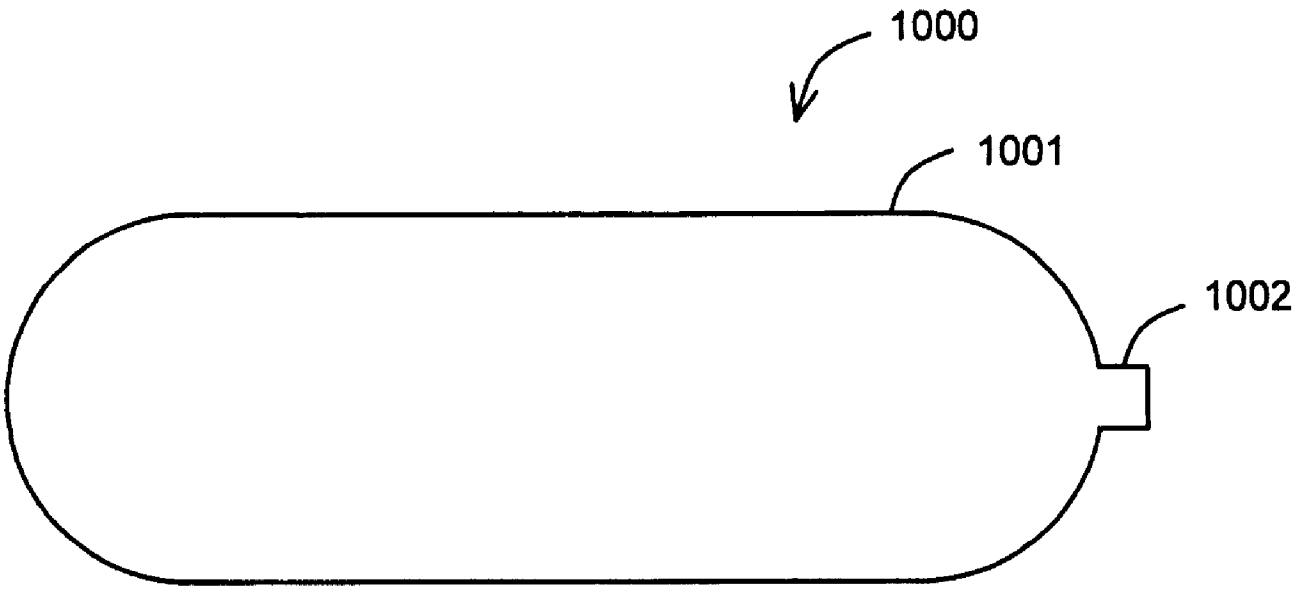
FIG. 22 is a diagram illustrating one embodiment of a dissolvable mandrel.

FIG. 22 is a diagram illustrating one embodiment of a dissolvable mandrel 1000. The mandrel 1000 has a body 1001 that is shaped to pattern the interior of the pressure vessel 10 and includes an end fitting 1002 protruding from the mandrel body 1001. The mandrel 1000 is prepared from a material that is soluble in a liquid that does not dissolve or affect the materials that are used to construct the pressure vessel 10 itself. In one embodiment, the mandrel 1000 is fashioned from a water-soluble material such as a mixture of plaster of Paris and water soluble fillers. Plies of composite material are then laid up over the soluble mandrel 1000, and cured to form the liner shell 16. This can be accomplished using the techniques outlined above for the two part liner shell 16 embodiment.

Figure 23:
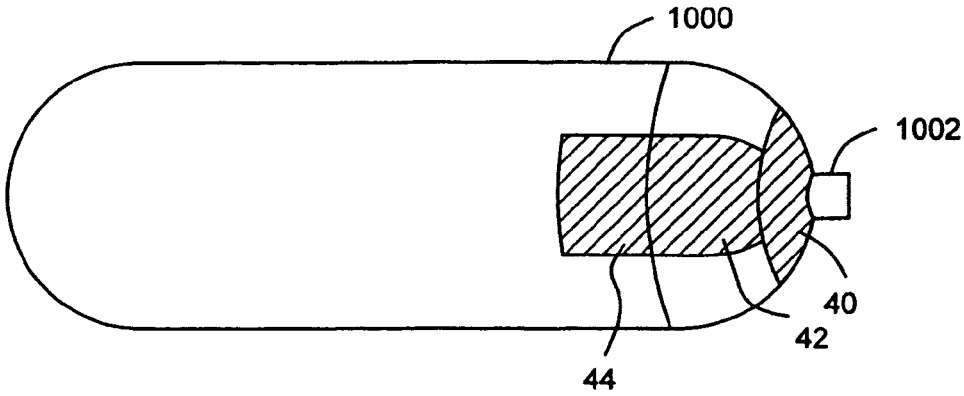
FIG. 23 is a diagram illustrating one technique that can be used to lay up composite material on the mandrel.

FIG. 23 is a diagram illustrating one technique that can be used to lay up composite material on the mandrel 1000. In this embodiment, the technique used is the same technique that is outlined above. Namely, each layer or ply of material is laid on the mandrel in accordance with a specific layup schedule. To account for the shape of the mandrel 1000, this generally requires the use of a number of patterned fabric pieces, including doily pattern 40, field patter 42, and cylinder pattern 44. As before, the doily pattern 40 is annular in shape, with a central hole to permit placement over the end fitting 1002.

Figure 24:
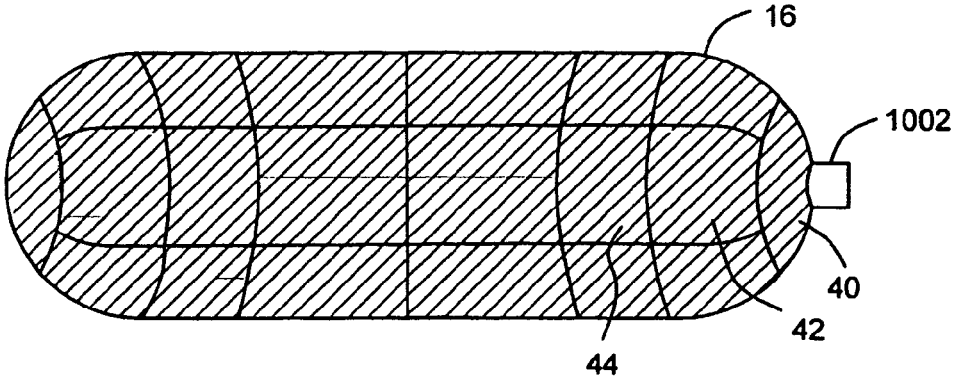
FIG. 24 is a diagram illustrating the completed liner shell after the laying up process is complete.

FIG. 24 is a diagram illustrating the completed liner shell 16 after the laying up process is complete. The liner shell 16 is then cured to form a rigid structure in the shape of the vessel 10 (and the mandrel 1000). Preferably, curing is done out of autoclave, for the reasons described above. At this point, the mandrel 1000 can be dissolved, leaving only the liner shell 16 with an opening 1004, as shown in FIG. 25.

Next, the mandrel 1000 is dissolved. In embodiments in which the mandrel is fashioned from water soluble materials, this can be accomplished by immersing the assembly in a water solution or by applying a water stream to the area of the end fitting. In embodiments where the mandrel 1000 is fashioned from materials soluble in other liquids, similar steps are performed.

Figure 25:
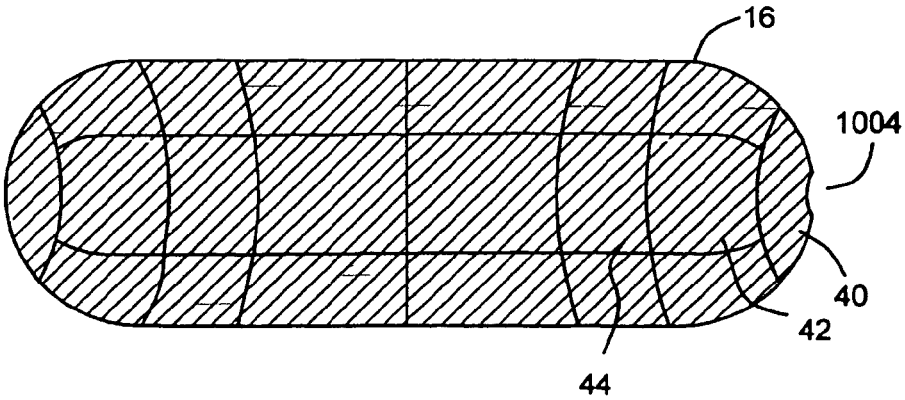
FIG. 25 is a diagram illustrating the completed liner shell with an opening after the mandrel is dissolved.

FIG. 25 is a diagram showing the assembly after the mandrel is dissolved.

Figure 26:
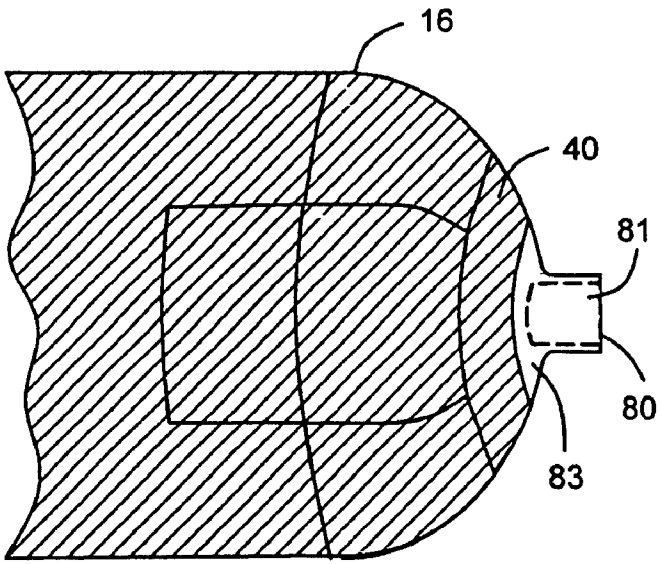

FIG. 26 is a diagram showing the installation of a boss 80 on the outer surface of the liner shell 16. The boss 80 includes a foot 83 and an aperture 81. When the boss 80 is mounted on the liner shell 16, the aperture 81 is adjacent to and communicates with the opening 1004, permitting the vessel 16 to be filled and evacuated as desired.

In the illustrated embodiment, the mounting of the boss 80 to the liner shell 16 is accomplished using techniques analogous to those outlined above. Since the boss or end fitting 80 must seat smoothly against the outer surface of the liner shell 16, the area at which the boss contacts the liner shell may include a removable peel ply to provide a bonding surface. Also, the bonding surface of the fitting may be scuffed, and both surfaces may be cleaned with a solvent to assure that both surfaces are clean. A suitable adhesive such as EA9361 is applied as a smooth layer to the outer surface of the liner shell near the opening 1004 where the boss 80 is to be mounted. The preferred thickness will depend on a number of factors including the strength and environmental requirements of the completed vessel 10 as well as the surface undulations of the outer surfaces of the liner shell 16 that contact the boss 80. The assembly may then be clamped or otherwise configured to ensure that there is constant pressure urging the boss 80 and the liner shell together while assembly is cured. To assure that the boss 80 is securely and sealingly attached to the liner shell 16, after curing, the under surface of the foot 83 of the boss 80 and the outer surface of the liner shell 16 may be further prepared. In one embodiment, this is accomplished by simply scuffing the outer surface of the liner shell 16 with a suitable abrasive. In another embodiment, the outer surface of the liner shell is abraded or sanded to a smooth surface with a shape that is complimentary to that of the matching surface of the boss 80.

In any case, as before, the boss 80 is applied until contact is made with the adhesive layer, then slowly rotated to ensure good contact, while applying pressure to allow any trapped air to escape through holes in the flange of the boss 80. Excess adhesive is smoothed around the periphery of the boss 80.

Figure 27:
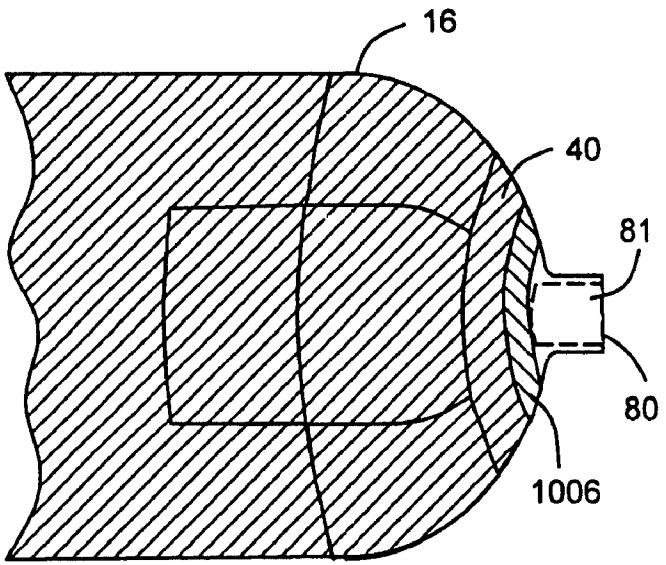
FIGS. 26 and 27 are diagrams illustrating the completed liner shell and attached boss with additional laid up plies to affix the boss to the liner shell.

FIG. 27 is a diagram showing how the seal between the boss 80 and the liner shell 16 can be improved by the laying up of additional doily shaped plies 1006 applied using the same techniques described above. This can be done alternatively or in addition to the foregoing steps.

Figure 28:
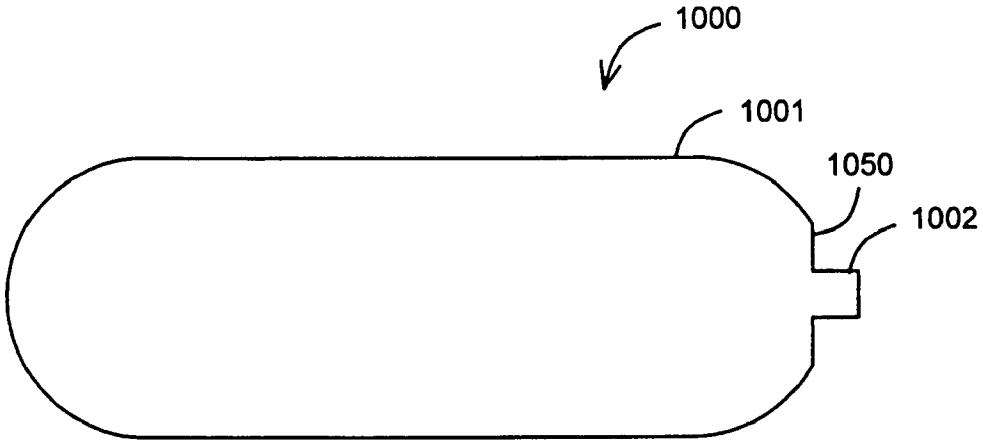
FIG. 28 is another embodiment of the mandrel having a flat portion.

FIG. 28 is a diagram illustrating another embodiment of the invention in which the mandrel 1000 includes a flat portion 1050. This embodiment is useful in an alternative embodiment in which the boss 80 comprises a flat surface that is fitted to complimentary a flat surface on the boss end of the shell liner 16. Composite material can be laid up on the mandrel 1000 using the same techniques described above. The doily pattern 40 may be changed to reflect the different shape of the mandrel 1000 at and near the flat portion 1050.

Figure 29:
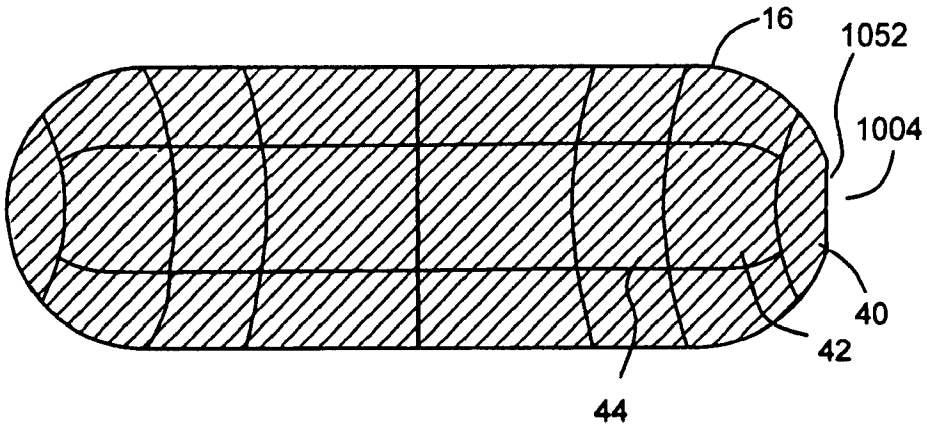
FIG. 29 is a diagram depicting the completed liner shell formed with the mandrel having the flat portion.

FIG. 29 is a diagram illustrating the liner shell 16 after the mandrel is dissolved. At this point, the liner shell 16 includes a flat surface 1052. As shown below, a boss 80 will be affixed to this flat surface.

Figure 31:
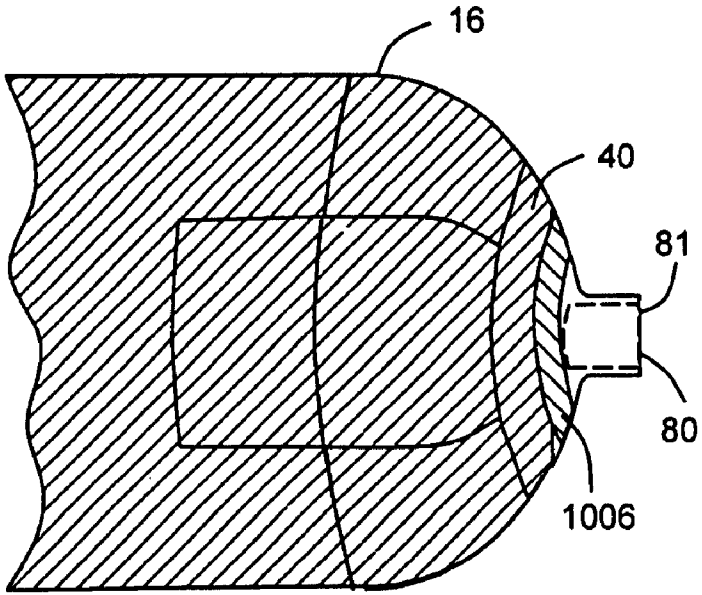
FIG. 31 is a diagram illustrating the completed liner shell and attached boss with additional laid up plies to affix the boss to the liner shell.
Figure 30:
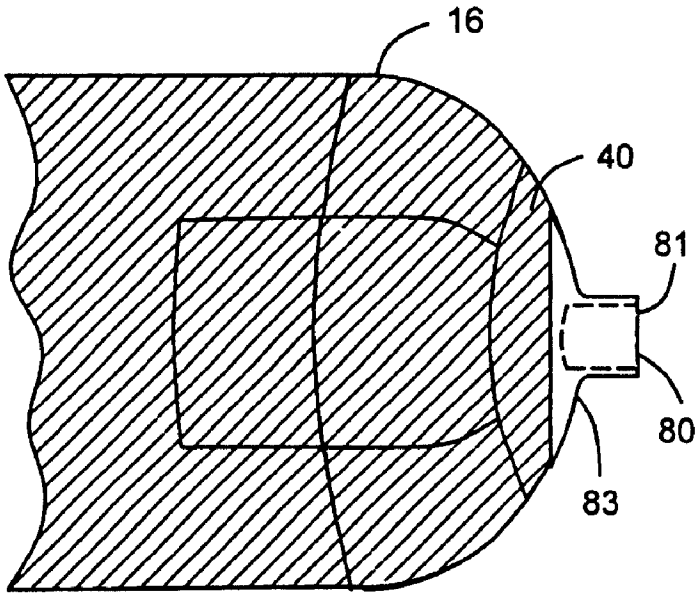
FIG. 30 is a diagram illustrating the completed liner shell having the flat portion and attachment of a boss having a complimentary flat portion.

FIG. 30 is a diagram illustrating the boss 80 affixed to the liner shell 16. In this embodiment, the bottom surface of the boss 80 is flat so as to match the flat surface presented to the boss 80 by the liner shell 16. As before, the flat liner shell surface can be sanded or otherwise prepared before a suitable adhesive is used to bond the boss 80 and the liner shell 16 together, and as before, clamping or other action is applied to the assembly during the (preferably out of autoclave) curing process to urge the boss 80 and the liner shell 16 together FIG. 31 is a diagram showing how in the foregoing flat boss mounting surface embodiment, the seal between the boss 80 and the liner shell 16 can be improved with additional layers of composite material.

Figure 32:
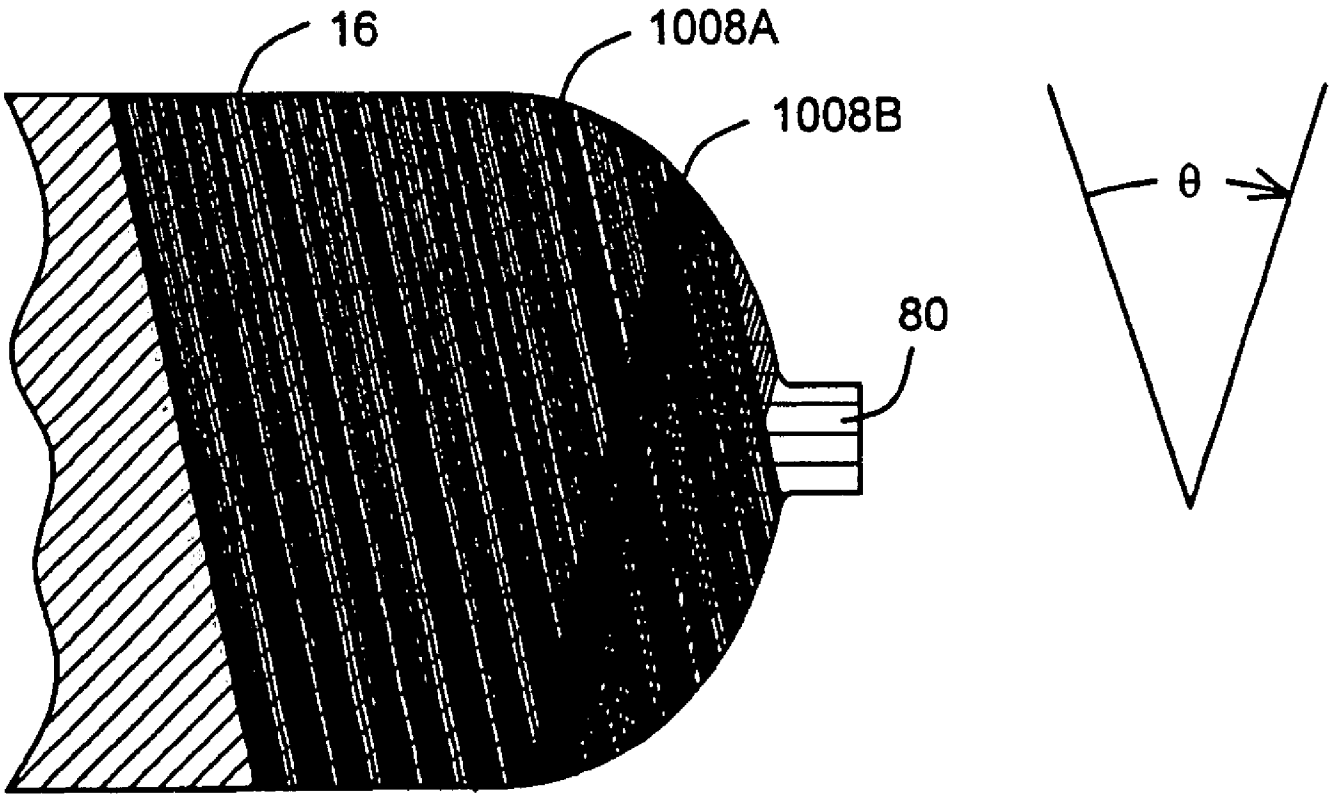
FIG. 32 is a diagram illustrating the liner shell and the foot of the mounted boss being overwrapped with wound filaments impregnated with a matrix material.

FIG. 32 is a diagram illustrating the liner shell 16 and the foot 83 of the mounted boss 80 being overwrapped with wound filaments 1008 impregnated with a matrix material. Note that the filaments 1008 are wound so as to secure the boss 80 to the liner shell 16, and include layers 1008A, 1008B that are wound at an angle θ to one another. Again, this is accomplished using techniques analogous to those described in the "overlapping of liner" section above. This process includes applying helically and cylindrically wrapped layers at fiber angles that vary from layer to layer. Such fiber angles and winding patterns can include a 90-degree circularly wound layer, an 11-degree helically wound layer, and an 85-degree helically wound layer. The helical pattern of the windings are stepped out to reduce the amount of fiber/resin buildup that normally occurs as the winding head passes the ends of the liner shell 16. The layers are alternated to assure roughly uniform stress distribution throughout the completed tank's walls. The use of different wind angles, particularly in the load bearing portions of the vessel 10 further optimize load bearing capacity.

The overwrapped liner shell 16 is cured. Preferably, this is accomplished out of autoclave.

In the process described above, the mandrel 1000 is dissolved after the fabrication of the liner shell 16 and before the liner shell 16 is overwrapped to complete the pressure vessel 10. In another embodiment, the mandrel 1000 is not dissolved until the after the liner shell 16 has been overwrapped. In this embodiment, the end fitting 1002 of the mandrel 1000 can be detached before the boss 80 is installed. This can be done in a variety of ways. For example, in one embodiment, the mandrel 1000 is a one piece assembly, the end fitting 1002 is simply cut or sawed off before the boss 80 is installed. In another embodiment, the end fitting 1002 is attached to the mandrel 1000 either by adhesive or mechanical means (it may be glued or screwed into the mandrel body 1001), and it is simply removed to permit attachment of the boss 80. In yet another embodiment, the interior shape of the end fitting 1002 is fabricated to match the corresponding shape of the boss 80, allowing the boss 80 to be mounted to the liner shell 16 without removing or otherwise altering the end fitting 1002.

Also in the above-described process, the shell liner 16 was constructed of laid up plies of composite material. In another embodiment, the present invention may be constructed by fabricating the shell liner 106 with filaments impregnated with matrix material that are overwrapped over the mandrel 1000 and cured.

CONCLUSION

This concludes the description of the preferred embodiments of the present invention. It will be appreciated from the foregoing that the present invention represents a significant advance in techniques for fabricating pressure vessels used to contain cryogenic materials or for launch vehicle and other space applications. In particular, the invention is a departure from conventional metal lined pressure vessels. Because the pressure vessel of the invention includes a liner shell of composite material, which is overwrapped with additional composite layers to form the vessel structure, the vessel is lighter in weight and less costly than conventional vessels for the same purpose, and yet performs as well in harsh environments. The technique of the invention can be used to fabricate vessels for storage of cryogenic materials, rocket fuels, or other materials. It will also be appreciated that, although specific embodiments of the invention have been described in detail for purposes of illustration, various modifications may be made without departing from the spirit and scope of the invention. Accordingly, the invention should not be limited except as by the appended claims.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of constructing a pressure vessel, comprising the steps of:

preparing a soluble mandrel on which a liner shell is to be fabricated, the mandrel having body shaped to pattern an interior of the pressure vessel, and including an end fitting protruding from the tool body at a location of a desired opening in the pressure vessel;

laying up plies of composite material over the soluble mandrel in multiple layers that cover the mandrel completely but leave the end fitting protruding through the layers of composite material;

curing the liner shell to form a rigid structure in the shape of the vessel;

mounting a boss having an aperture therethrough on the outer surface of the shell with the aperture disposed adjacent the desired opening in the pressure vessel;

overwrapping the liner shell and mounted boss but not the aperture with wound filaments impregnated with matrix material; and curing the over wrapped liner shell and mounted boss.

2. The method of claim 1, wherein the step of mounting a boss on the outer surface of the shell over the desired opening in the pressure vessel comprises the steps of:

preparing a surface of the boss and a surface of the liner shell to receive the boss;

applying an adhesive to the surface of the liner shell around the opening to receive the boss; and positioning the boss over the end fitting.

3. The method of claim 2, wherein the step of preparing a surface of the boss and a surface of the liner shell to receive the boss includes the step of abrading the liner shell to a shape complimentary to the surface of the boss.

4. The method of claim 2, wherein the step of overwrapping the liner shell and mounted boss comprises the steps of:

applying layers at fiber angles that vary from layer to layer, wherein the layers include circularly and helically wound layers extending over the positioned boss and the liner shell.

5. The method of claim 4, wherein the layers comprise layers having fiber angles and windings that are selected from the group consisting of:

a 90-degree circularly wound layer;

an 11 degree helically wound layer; and an 85-degree helically wound layer.

6. The method of claim 1, wherein the plies of composite material are laid up in layers angularly displaced from adjacent layers by an angle selected from the group comprising 90 and 45 degrees.

7. The method of claim 1, wherein the liner shell is cured out of autoclave.

8. The method of claim 1, wherein the overwrapped liner shell is cured out of autoclave.

9. The method of claim 1, further comprising the step of:

dissolving the mandrel after curing the overwrapped liner shell and mounted boss.

10. The method of claim 1, further comprising the step of:

dissolving the mandrel after curing the liner shell.

11. The method of claim 1, wherein the mandrel is body shaped to pattern the entire interior of the pressure vessel.

12. A method of constructing a pressure vessel, comprising the steps of:

preparing a soluble mandrel on which a liner shell is to be fabricated, the mandrel having body shaped to pattern an interior of the pressure vessel, and including an end fitting protruding from the tool body at a location of a desired opening in the pressure vessel;

filament winding plies of composite material over the mandrel in multiple layers that cover the body completely but leave the end fitting protruding from the layers of composite material;

curing the liner shell to form a rigid structure in the shape of the vessel;

mounting a boss having an aperture therethrough on the outer surface of the shell with the aperture disposed over the desired opening in the pressure vessel;

overwrapping the liner shell and mounted boss but not the aperture with wound filaments impregnated with matrix material; and curing the over wrapped liner shell and mounted boss.

13. The method of claim 12, wherein the step of mounting a boss on the outer surface of the shell over the desired opening in the pressure vessel comprises the steps of:

preparing a surface of the boss and a surface of the liner shell to receive the boss;

applying an adhesive to the surface of the liner shell around the opening to receive the boss; and positioning the boss over the end fitting.

14. The method of claim 13, wherein the step of preparing a surface of the boss and a surface of the liner shell to receive the boss includes the step of abrading the liner shell to a shape complimentary to the surface of the boss.

15. The method of claim 13, wherein the step of overwrapping the liner shell and mounted boss comprises the steps of:

applying layers at fiber angles that vary from layer to layer, wherein the layers include circularly and helically wound layers extending over the positioned boss and the liner shell.

16. The method of claim 15, wherein the layers comprise layers having fiber angles and windings that are selected from the group consisting of:

a 90-degree circularly wound layer;

an 11 degree helically wound layer; and an 85-degree helically wound layer.

17. The method of claim 12, wherein the liner shell is cured out of autoclave.

18. The method of claim 12, wherein the overwrapped liner shell is cured out of autoclave.

19. The method of claim 12, further comprising the step of:

dissolving the mandrel after curing the overwrapped liner shell and mounted boss.

20. The method of claim 12, further comprising the step of:

dissolving the mandrel after curing the liner shell.

* * * * *